US011393309B1

(12) United States Patent
Wang

(10) Patent No.: US 11,393,309 B1
(45) Date of Patent: Jul. 19, 2022

(54) SECURITY DEVICE, SYSTEM, AND METHOD OF USING THE SAME

(71) Applicant: Swann Communications U.S.A. Inc., Santa Fe Springs, CA (US)

(72) Inventor: Eric Wang, Taipei (TW)

(73) Assignee: Swann Communications U.S.A. Inc., Santa Fe Springs, CA (US)

( * ) Notice: Subject to any disclaimer, the term of this patent is extended or adjusted under 35 U.S.C. 154(b) by 0 days.

(21) Appl. No.: 17/102,544

(22) Filed: Nov. 24, 2020

Related U.S. Application Data

(60) Provisional application No. 63/036,529, filed on Jun. 9, 2020.

(51) Int. Cl.
*G08B 13/196* (2006.01)
*G08B 13/191* (2006.01)

(52) U.S. Cl.
CPC ..... *G08B 13/19602* (2013.01); *G08B 13/191* (2013.01); *G08B 13/19656* (2013.01)

(58) Field of Classification Search
CPC ..... G08B 13/19602; G08B 5/38; G08B 13/19695; G08B 25/008; G02B 3/08
See application file for complete search history.

(56) References Cited

U.S. PATENT DOCUMENTS 8,305,447 B1 * 11/2012 Wong ..... G08B 13/19602 348/151
2015/0029335 A1 * 1/2015 Kasmir ..... H04M 1/0291 348/143
2020/0090480 A1 * 3/2020 Sacre ..... G03B 15/03
2020/0177812 A1 * 6/2020 Duran ..... H04N 5/243

OTHER PUBLICATIONS

Swann 2020 Vision—The Future of Secuirty is Here, CES at the Las Vegas Convention Center, Las Vegas, NV, Jan. 7, 2020.
Enforcer Cam, <https://www. youtube. com/watch?v=asq7bjaMWsI>, Jan. 23, 2020.

* cited by examiner

*Primary Examiner* — Mirza F Alam
(74) *Attorney, Agent, or Firm* — Fox Rothschild LLP; Paul Marshall Ticer

(57) ABSTRACT

This disclosure relates to wired, wireless, and Wi-Fi security devices such as security cameras, security motion lighting, and security networks. Disclosed security devices may include at least one camera, and at least one thermal motion sensor. Additionally, disclosed devices may include a first lighting feature configured to emit light of a first color and a second lighting feature configured to emit light of a second color different than the first color. Disclosed devices may include a controller configured to detect an actionable event, and activate a deterrent protocol if the actionable event is detected. The actionable event may include video motion detection including video data processing performed on a pixel by pixel basis and thermal motion detection including thermal data processing. The deterrent protocol may activate the first lighting feature and the second lighting feature according to a pre-determined lighting pattern, for example a police style lighting pattern.

18 Claims, 14 Drawing Sheets
(11 of 14 Drawing Sheet(s) Filed in Color)

100

100

SECURITY DEVICE, SYSTEM, AND METHOD OF USING THE SAME

CROSS-REFERENCE TO RELATED APPLICATIONS

This application claims priority to U.S. Provisional Application Ser. No. 63/036,529, filed Jun. 9, 2020, the contents of which are incorporated herein in their entirety.

FIELD

The present technology is generally related to security cameras, surveillance cameras, security lighting, closed circuit television (CCTV) devices, intelligent indoor and outdoor lighting, intelligent motion triggered lights, and associated recording systems optimized for local storage and cloud based storage. Additionally, the present technology encompasses smart devices and associated applications for viewing CCTV data and activating at least one deterrence feature. Disclosed devices may include wireless battery powered power sources, solar powered power sources, and/or hard wired power sources. Disclosed devices may integrate with other cloud-based systems such as Google Assistant, Amazon Alexa, and other relevant smart home device platforms, for example. Additionally, disclosed devices may send and receive information locally and/or externally over wired and wireless networks, for example.

BACKGROUND

Conventional CCTV devices have generally focused on surveillance monitoring and the recordation of recorded surveillance footage. Additionally, conventional CCTV devices have been a one size fits all format and have not provided an end user with customizable and/or user programmable criteria to alert an end user of a potentially relevant incident. For example, conventional CCTV devices have long lacked an automatically activated deterrence capability as well as an end user activated deterrence capability.

SUMMARY

The techniques and apparatuses of this disclosure generally relate, for example, to CCTV security devices and CCTV security networks for actively monitoring a specific location and/or multiple specific locations. Disclosed devices, networks, and systems may utilize at least one deterrent feature such as a visual warning, notification, and/or audible siren, for example, to actively deter, prevent and/or suppress the likelihood of an unwanted act or crime from occurring. An additional aspect of this disclosure relates to intelligent lighting systems that utilize at least one deterrent feature such as a visual warning, notification, and/or audible siren, for example, to actively prevent and/or suppress the likelihood of an unwanted act or crime from occurring. As used herein, the term "intelligent", when used in conjunction with disclosed devices, may refer to a device having computer implemented and/or pre-programmed logic in hardware or software that may selectively activate and/or trigger at least one outcome and/or event. An example event may include a deterrent effect such as flashing lights and/or an audible siren. Particular examples of deterrent effects and triggering events will be explained in more detail below.

In one aspect, a security device is disclosed. The security device may include at least one camera and at least one thermal motion sensor, for example. The device may further include a first lighting feature configured to emit light of a first color and a second lighting feature configured to emit light of a second color different than the first color. The device may further include a controller including at least one processor and non-transitory computer readable media, and the controller being in communication with the at least one camera and the at least one thermal motion sensor. The controller may be configured to: detect at least one actionable event, and activate at least one deterrent protocol if the at least one actionable event is detected. In some embodiments, the at least one actionable event includes video motion detection including video data processing performed on a pixel by pixel basis of a video feed from the at least one camera. Additionally, in some embodiments the video motion detection may be detected at least twice within a duration of time, for example. Furthermore, in some embodiments, the at least one actionable event may further include thermal motion detection including thermal data processing of a thermal motion feed from the at least one thermal motion sensor, and the thermal motion detection may be detected at least twice within the duration of time, for example. In some embodiments, the at least one deterrent protocol further includes activating the first lighting feature and the second lighting feature according to a pre-determined lighting pattern, for example. In some embodiments the security device may communicate with other local security devices and external security networks over a wired network and/or over a wireless network such as Wi-Fi, for example.

In another aspect, the first lighting feature may be configured to emit red light and the second lighting feature may be configured to emit blue light, for example.

In another aspect, disclosed devices may further include a third lighting feature configured to emit white light, and a speaker configured to generate at least one audible deterrent sound. In some embodiments, the at least one deterrent protocol further includes activating the third lighting feature according to the pre-determined lighting pattern, and activating the speaker.

In another aspect, the controller may be in communication with an external security ecosystem network, and the controller may be further configured to activate the at least one deterrent protocol upon receiving a deterrent signal from the external security ecosystem network, for example.

In another aspect, the at least one camera may be a high definition camera, for example Additionally, the at least one camera may communicate with other cameras, local security devices, and external security networks over a wired network and/or over a wireless network such as Wi-Fi, for example.

In another aspect, the at least one camera may be a high definition camera with color night vision capability, for example.

In another aspect, the at least one thermal motion sensor may be a passive infrared sensor, for example.

In another aspect, in some embodiments, criteria of the at least actionable event may be configurable by an end user.

In another aspect, in some embodiments, criteria of the at least one deterrent protocol may be configurable by an end user.

In another aspect a lighting device is disclosed. The lighting device may include at least one thermal motion sensor, and a first lighting feature configured to emit light of a first color and a second lighting feature configured to emit light of a second color different than the first color, for example. The lighting device may further include a controller including at least one processor and non-transitory computer readable media, and the controller may be in communication with the at least one thermal motion sensor. In some embodiments, the controller may be configured to detect at least one actionable event, and activate at least one deterrent protocol if the at least one actionable event is detected. In some embodiments, the at least one actionable event includes thermal motion detection including thermal data processing of a thermal motion feed from the at least one thermal motion sensor, and the thermal motion detection may be detected at least twice within a duration of time, for example. In some embodiments, the at least one deterrent protocol includes activating the first lighting feature and the second lighting feature according to a pre-determined lighting pattern, for example.

In another aspect, the first lighting feature may be configured to emit red light and the second lighting feature may be configured to emit blue light, for example.

In another aspect, a third lighting feature may be configured to emit white light, and the at least one deterrent protocol may further include activating the third lighting feature according to the pre-determined lighting pattern.

In another aspect, some embodiments may include a third lighting feature configured to emit white light, and a speaker configured to generate at least one audible deterrent sound. Additionally, in some embodiments, the at least one deterrent protocol further includes activating the third lighting feature according to the pre-determined lighting pattern, and activating the speaker.

In another aspect, the lighting device may be a battery powered device, for example.

In another aspect, the lighting device may be a solar powered device, for example.

In another aspect, the lighting device may be a line voltage powered device.

In another aspect, a security system is disclosed. The security system may include a plurality of security devices and/or disclosed lighting devices as explained above. The security system may include at least one digital video recorder in communication with the at least one security device and an external security ecosystem network. The at least one digital video recorder may be configured to send a local video signal output including a partitioned viewing area comprising the video feed from each security device of the plurality of security devices. The at least one digital video recorder may also be configured to: store video data received from each security device of the plurality of security devices locally, transmit the video data received from each security device of the plurality of security devices to the external security ecosystem network, and receive at least one control signal from the external security ecosystem network, wherein the at least one control signal activates the at least one security device locally, for example.

In another aspect, each first lighting feature of each of the plurality of security devices may be configured to emit red light and each second lighting feature of each of the plurality of security devices may be configured to emit blue light, for example.

In another aspect, some embodiments may further include a third lighting feature configured to emit white light, and a speaker configured to generate at least one audible deterrent sound. Additionally, in some embodiments, the at least one deterrent protocol may further include activating the third lighting feature according to the pre-determined lighting pattern, for example.

In another aspect, in some embodiments, the at least one thermal motion sensor is a passive infrared sensor.

The details of one or more aspects of the disclosure are set forth in the accompanying drawings and the description below. Other features, objects, and advantages of the techniques and devices described in this disclosure will be apparent from the description and drawings, and from the claims.

BRIEF DESCRIPTION OF DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
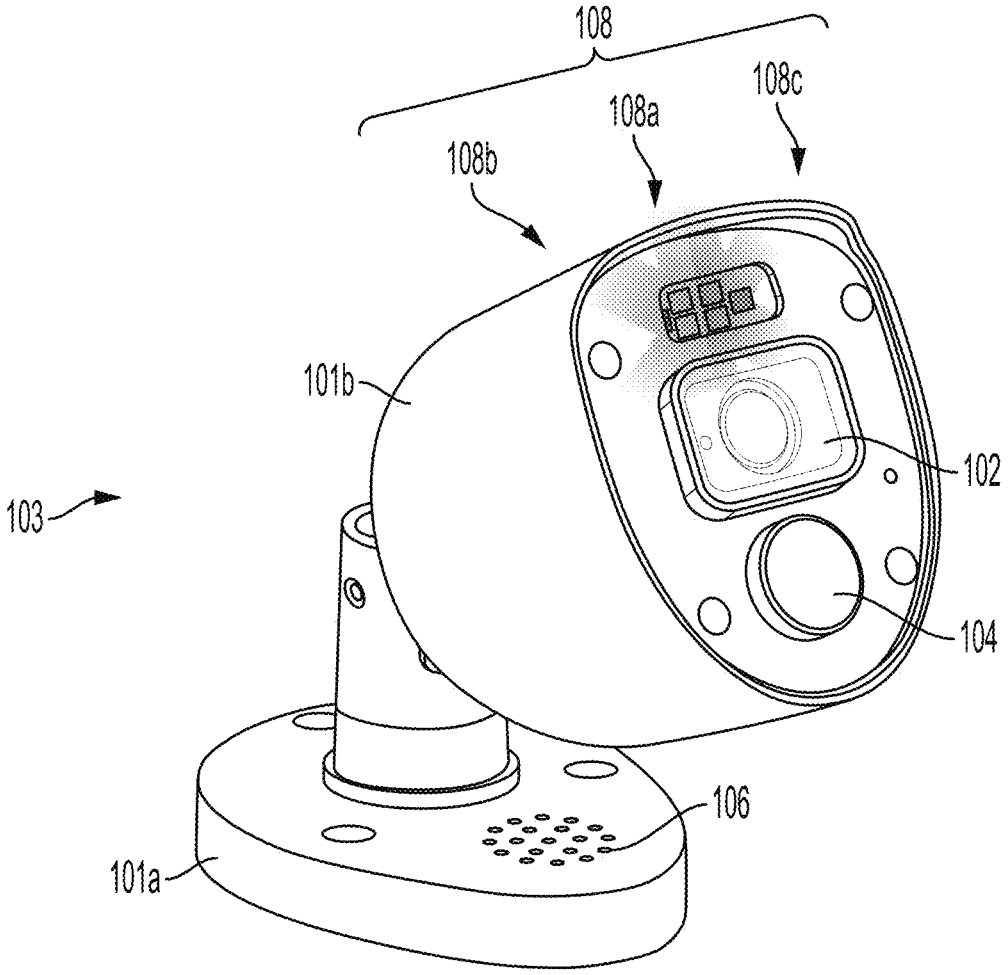
FIG. 1 is a perspective view drawing of a security camera.

Disclosed example embodiments relate to customizable security devices, networks, and systems that may utilize at least one deterrent such as a visual warning, notification, and/or audible siren to actively prevent and/or suppress the likelihood of an unwanted act or crime occurring. Relevant criteria that may activate the at least one deterrent may be and/or include video pixel by pixel based detection motion sensors, passive infrared motion sensors, and combinations thereof. In at least one embodiment, a user may activate the at least one deterrent from a networked device such as a computer, smartphone, or tablet, for example. Additionally, in disclosed embodiments, red and blue flashing lights and/or an audible siren may be automatically activated as a deterrent and/or activated by an user via a smartphone and security ecosystem.

The present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. Stated another way, the disclosed embodiments are solely meant to be examples of the inventive concepts herein and should not be construed as limiting or appending the scope of the disclosure. In some embodiments, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value and all numerical values therebetween. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure.

It should be understood that various aspects disclosed herein may be combined in different combinations than the combinations specifically presented in the description and accompanying drawings. For example, features from one embodiment may be combined with features of another embodiment unless the context clearly indicates such combinations to be mutually exclusive. At least one example is that one embodiment may explain that communication protocols and methods may occur over wired components such as Ethernet and/or Coax cable whereas another embodiment may explain that communication protocols and methods may occur over wireless components under a wireless communication standard such as Wi-Fi, Bluetooth, ZigBee, and etc. It shall be understood, that each embodiment's particular communication hardware, and communication protocols and methods are equally applicable to the other, i.e., they may be substituted and/or interchanged freely within the scope of this disclosure. It should also be understood that, depending on the example, certain acts or events of any of the processes or methods described herein may be performed in a different sequence, may be added, merged, or left out altogether (e.g., all described acts or events may not be necessary to carry out the techniques). In addition, while certain aspects of this disclosure are described as being performed by a single module or unit for purposes of clarity, it should be understood that the techniques of this disclosure may be performed by a combination of units or modules associated with, for example, a security camera and/or lighting.

In one or more examples, the described techniques may be implemented in hardware, software, firmware, cloud based architecture or any combination thereof. If implemented in software, the functions may be stored as one or more instructions or code on a computer-readable medium and executed by a hardware-based processing unit, e.g., a controller and/or a processor. Computer-readable media may include non-transitory computer-readable media, which corresponds to a tangible medium such as data storage media (e.g., RAM, ROM, EEPROM, flash memory, or any other medium that can be used to store desired program code in the form of instructions or data structures and that can be accessed by a computer).

In one or more examples, the described embodiments may include at least one networking component configured to send and receive data, signals, and/or information. At least one example may be wired technologies for networking and/or wireless technologies for networking. In disclosed embodiments, security cameras and video recorders may communicate with one another over Wi-Fi and access the internet broadly over Wi-Fi through a local area network. A local area network may include various access points, repeaters, amplifiers, wireless adapters, routers, bridges, and etc. as would be understood by a person having ordinary skill in the relevant art. As used herein, the term Wi-Fi shall be understood to have its ordinary technical meaning, for example, wireless network protocols, based on the IEEE 802.11 family of standards and their improvements. However, it shall be understood that disclosed devices may communicate "wirelessly" more broadly over other standards (in addition to Wi-Fi standards), such as Bluetooth, Zigbee, WiMax, and etc.

Instructions may be executed by one or more processors and/or control units, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor" as used herein may refer to any of the foregoing structure or any other physical structure suitable for implementation of the described techniques as would be understood by a person skilled in the relevant art. In addition, the techniques could be fully implemented in one or more circuits or logic elements.

FIG. 1 is a perspective view drawing of a security camera 100. Security camera 100 may include a mounting portion 101*a* for affixing the body 101*b* of security camera 100 to an external structure such as a wall, ceiling, or post, for example. Security camera 100 may be an indoor or an outdoor rated camera, e.g., camera 100 may be an IP65, IP66, IP67 rated enclosure. An IP65 enclosure may refer to an enclosure that is protected against water projected from a nozzle; an IP66 enclosure may be protected against heavy seas or powerful jets of water; and an IP 67 enclosure may be protected against full immersion in water. Additionally, body 101*b* may pivot with respect to mounting portion 101*a* at a pivoting joint (not labelled). Security camera 100 may also include a camera 102, a controller 103, a motion sensor 104, a speaker 106, and at least one lighting feature 108. Camera 102 may be and/or include an electronic image sensor such as a charge-coupled device (CCD) and/or an active-pixel sensor such as a complementary metal oxide semiconductor (CMOS sensor).

Camera 102 may function in the analog domain or in the digital domain. Camera 102 may be a standard camera or a night vision camera, for example Camera 102 may send a live video feed to controller 103 for data processing or camera 102 may have integrated sensors. Additionally, the live video feed from camera 102 may be sent to a video recorder (see FIGS. 6A-6C), such as a digital video recorder (DVR) via a coax cable such as a Bayonet Neill-Concelman (BNC) connector or the like. In other embodiments, the live video feed from camera 102 may be sent to a Networked Video Recorder (NVR) via an Ethernet cable or the like, such as, for example, RJ45 connectors, Cat 5 connectors, or Cat 6 connectors. Similarly, in some embodiments, the live video feed from camera 102 may be sent to a Networked Video Recorder (NVR) wirelessly, for example over Wi-Fi. In some embodiments, camera 102 may include a plurality of photodiodes and CMOS transistor switches (not illustrated) configured to generate an electrical signal on a pixel by pixel basis. The generated electrical signal may vary according to the light intensity of the external viewing area corresponding to the particular pixel. The various electrical signals of camera 102 may be analyzed and/or synthesized by a controller 103 housed within an interior space of the camera body 101*b*. Controller 103 may compare the generated electrical signals on a pixel by pixel basis to detect motion as is understood by a person having ordinary skill in the art (POSA). As used herein "electrical signal" is intended to have its ordinary technical meaning, for example, relatively small bursts of electrical current that conveys information. Additionally, as used herein "control signal" is intended to be a sub-type of electrical signal that causes at least one effect beyond the mere sending of an electrical signal. For example, a control signal may activate or turn on another component, e.g., a process, a lighting feature, a recordation feature, and/or a speaker.

Motion sensor 104 may be any type of motion sensor such as a passive infrared (PIR) sensor, microwave sensor, and dual tech/hybrid sensors that utilize a combination of PIR sensors and microwave sensors. In at least one embodiment, motion sensor 104 is a PIR sensor including a Fresnel lens to increase the detectable area by channeling off angle infrared radiation from a relatively wider viewing area to the sensor. Motion sensor 104 may include a pyroelectric sensor that is tuned and configured to detect levels of infrared radiation corresponding to that of a human body's heat signature and distinguish the infrared radiation of the human body's heat signature from other types of infrared radiation. For example, the pyroelectric sensor may send an electrical signal to controller 103 notifying controller 103 that heat source movement associated with a heat signature corresponding to that of a human body has been detected.

Speaker 106 may be a loudspeaker or siren, for example. In some embodiments, speaker 106 may include a microphone for capturing audio and transmitting the captured audio as a corresponding electrical signal to the controller 103. Speaker 106 may be configured to generate any type of sound and in some embodiments multiple speakers may be provided, for example a low frequency speaker, a mid frequency speaker, and a high frequency speaker. In some embodiments, speaker 106 may be configured to generate a police style siren sound upon receipt of a control signal from controller 103.

In the disclosed embodiment of FIG. 1, lighting feature 108 may include three distinct lighting sub-features having distinct colors. For example, first lighting feature 108*a* may include at least one light emitting diode (LED) cell that transmits white light, for example. In the disclosed embodiment, first lighting feature 108*a* includes four LED cells configured to transmit white light when activated by a control signal of controller 103. Second lighting feature 108*b* may include at least one LED cell that transmits red light, for example. In the disclosed embodiment, second lighting feature 108*b* includes one LED cell configured to transmit red light when activated by a control signal of controller 103. Third lighting feature 108*c* may include at least one LED cell that transmits blue light, for example. In the disclosed embodiment, third lighting feature 108*c* includes one LED cell configured to transmit blue light when activated by a control signal of controller 103.

At least one object of the presently disclosed security camera 100 is the active prevention, deterrence, and/or suppression of unwanted acts and/or crime. In this regard, controller 103 may include at least one processor and non-transitory computer readable media in hardware componentry configured to detect at least one actionable event and initiate at least one deterrent protocol. To effect this outcome, controller 103 may be in communication with camera 102 and motion sensor 104 as previously explained. For example, controller 103 may continuously receive electrical signal output from camera 102 and motion sensor 104. As explained above, camera 102 may include a camera motion sensor which may not require controller 103 to perform significant data parsing and/or analysis. Alternatively, controller 103 may perform analysis of a live video stream of camera 102 to detect motion on a pixel by pixel basis, for example Additionally, controller 103 may perform at least some data processing in those embodiments where camera 102 includes a camera sensor, for example controller 103 may at least interpret an electrical signal from camera 102 indicating motion where camera 102 has already determined motion has occurred. Controller 103 may be configured to detect at least one actionable event, and activate at least one deterrent protocol if the at least one actionable event is detected.

An example actionable event may include video motion detection including video data processing performed on a pixel by pixel basis of a video feed from camera 102. In some embodiments, video motion detection may be required to be detected for a minimum time period in order to avoid false positives. For example, in at least one embodiment, video motion detection must be detected by controller 103 and/or camera 102 at least twice within a duration of time ranging from 0.25 seconds to about 3.0 seconds and more particularly about 1 second. In other embodiments, video motion detection must be detected more than twice within the above disclosed duration of time. Additionally, an example actionable event may include thermal motion detection including thermal data processing of a thermal motion feed from motion sensor 104. For example, thermal motion detection may be required to be detected at least twice within a duration of time ranging from 0.25 seconds to about 3.0 seconds and more particularly about 1 second. In other embodiments, video motion detection must be detected more than twice within the above disclosed duration of time.

An example deterrent protocol may include various control functions performed by controller 103 as explained above. For example, controller 103 may activate at least one lighting feature 108 and the various sub component lighting features 108*a*, 108*b*, and 108*c* according to a pre-determined lighting pattern. It shall be understood that activating the at least one lighting feature 108 may selectively include activation of the various sub component lighting features 108*a*, 108*b*, and 108*c* according to a pre-determined lighting pattern individually and in each possible combination. In some embodiments, the pre-determined lighting pattern may include flashing or pulsing the red, white, and blue lights of lighting features 108*a*, 108*b*, and 108*c* in a way that resembles a police style warning deterrent, for example. Additionally, in some embodiments, the deterrent protocol may include activation of speaker 106. For example, controller 103 may send a control signal to speaker 106 activating it and thereby generating a loud siren sound.

An example table summarizing at least one embodiment of criteria that may amount to an actionable event resulting in controller 103 activating the deterrent protocol is disclosed below.

Example Table Summary of Actionable Event/Deterrent Protocol

| | Camera/Controller Motion Detection | Thermal Image Motion Detection | Result |
|---|---|---|---|
| 1 | Detected | Not Detected And/or Heat Signature detected not corresponding to human being | No detection of actionable event No Activation of Deterrent Protocol |
| 2 | A single motion event it detected | A heat signature movement corresponding to a human being is detected | No detection of actionable event No Activation of Deterrent Protocol |
| 3 | At least two motion events are detected on a pixel by pixel basis within a time span of about 1 second | At least two heat signature motion corresponding to a human being are detected within a time span of about 1 second | YES detection of actionable event YES Activation of Deterrent Protocol |
| 4 | No motion event(s) is(are) detected | Heat signature motion event(s) corresponding to a human being is(are) detected | No detection of actionable event No Activation of Deterrent Protocol |

Figure 2:
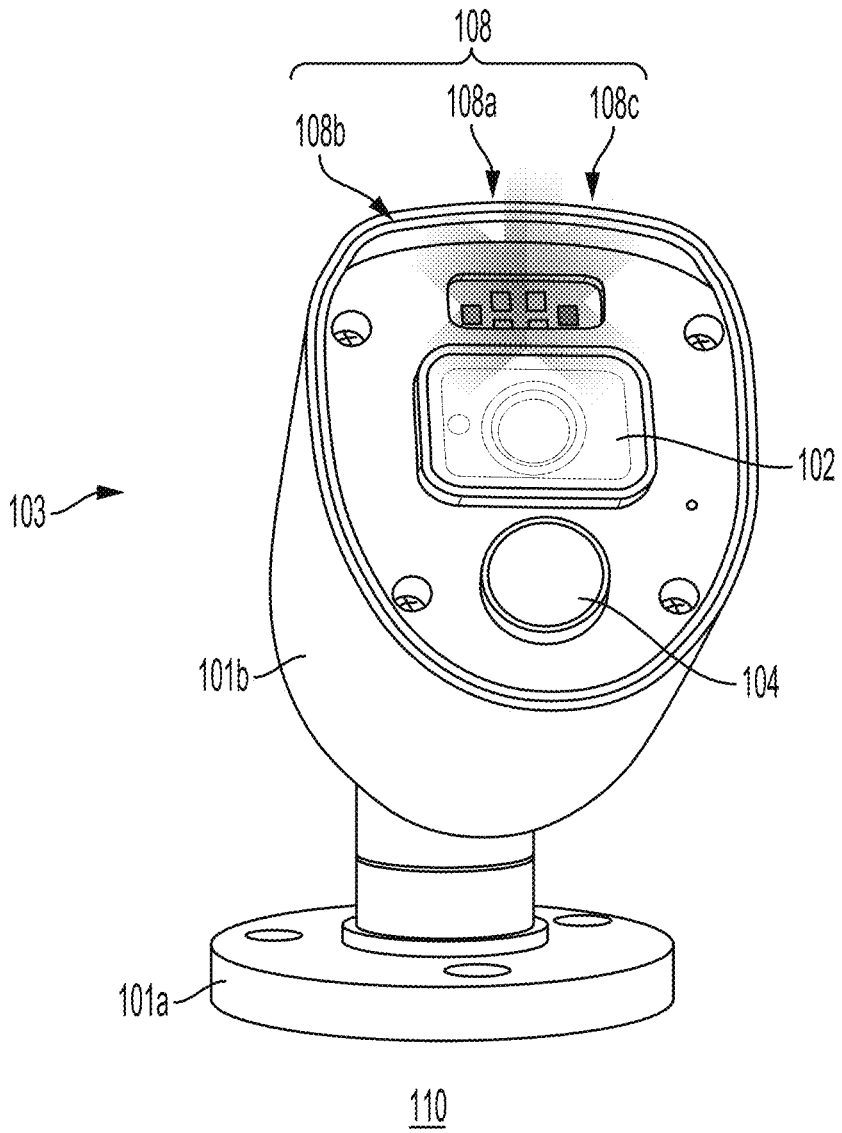
FIG. 2 is a perspective view drawing of a security camera.
Figure 3:
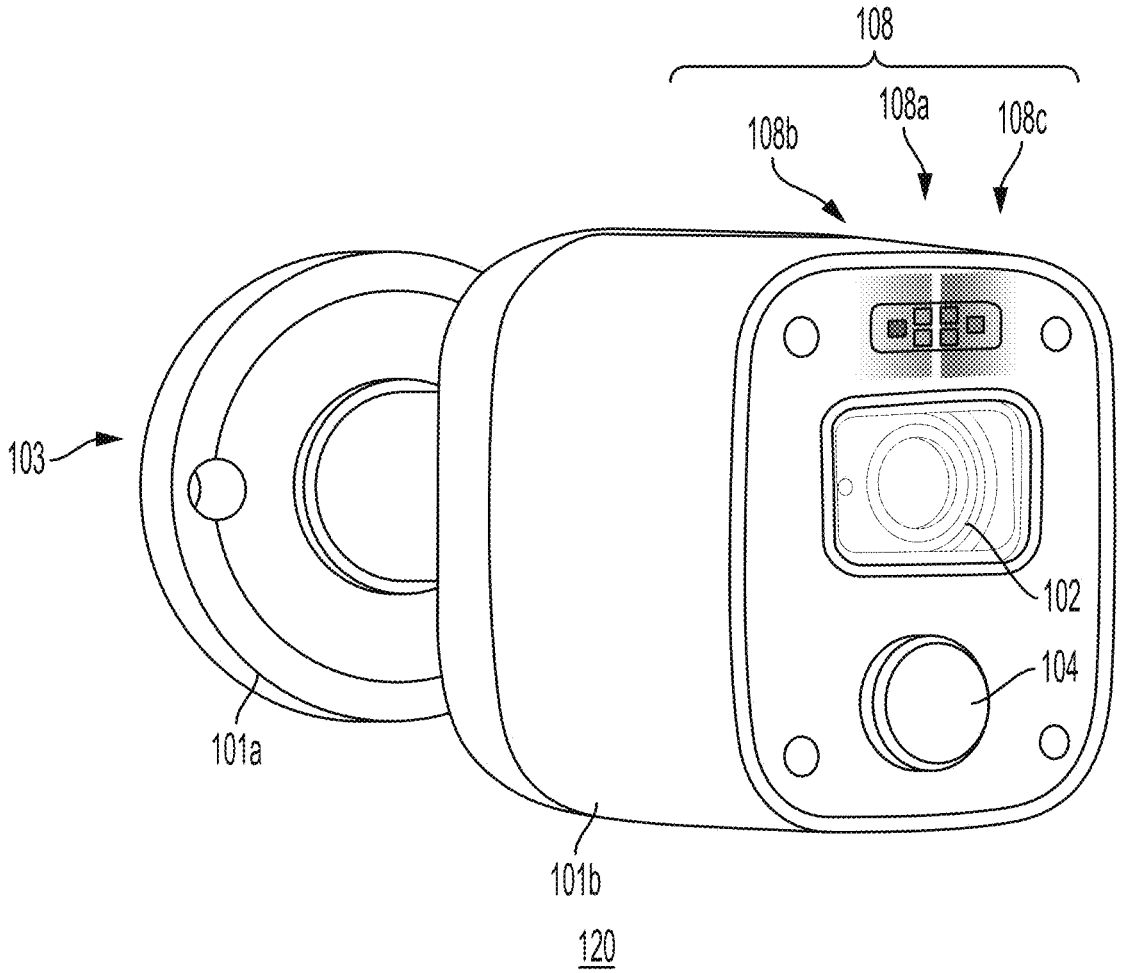
FIG. 3 is a front view drawing of a security camera.
Figure 4:
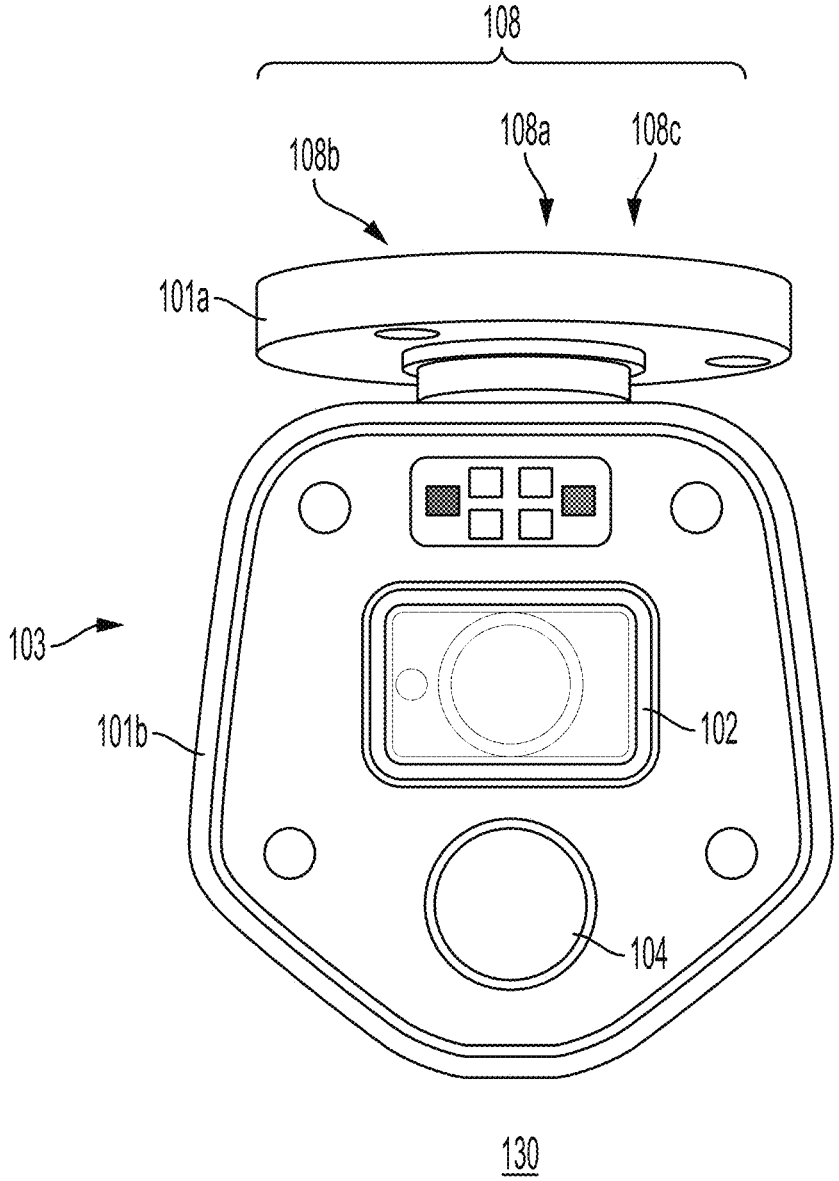
FIG. 4 is a perspective view drawing of a security camera.

FIG. 2 is a perspective view drawing of a security camera 110. Security camera 110 may include the same, similar, or substantially the same components and functionality as security camera 100. However, security camera 110 may not feature a speaker 106 like security camera 100. Alternatively, security camera 110 may include an integral speaker within the body 101*b* of camera 110 (not illustrated). FIG. 3 is a front view drawing of a security camera 120. Security camera 120 may include the same, similar, or substantially the same components and functionality as security cameras 100, 110. However, security camera 120 may have a rectangular body portion 101*b* and may not feature a speaker 106 like security camera 100. Additionally, security camera 120 may include an integral speaker within the body 101*b* of camera 120 (not illustrated). FIG. 4 is a perspective view drawing of a security camera 130. Security camera 130 may include the same, similar, or substantially the same components and functionality as security cameras 100, 110, and 120. However, security camera 130 may have a prismoidal body portion 101*b* and may not feature a speaker 106 like security camera 100. Additionally, security camera 120 may include an integral speaker within the body 101*b* of camera 130 (not illustrated).

Figure 5:
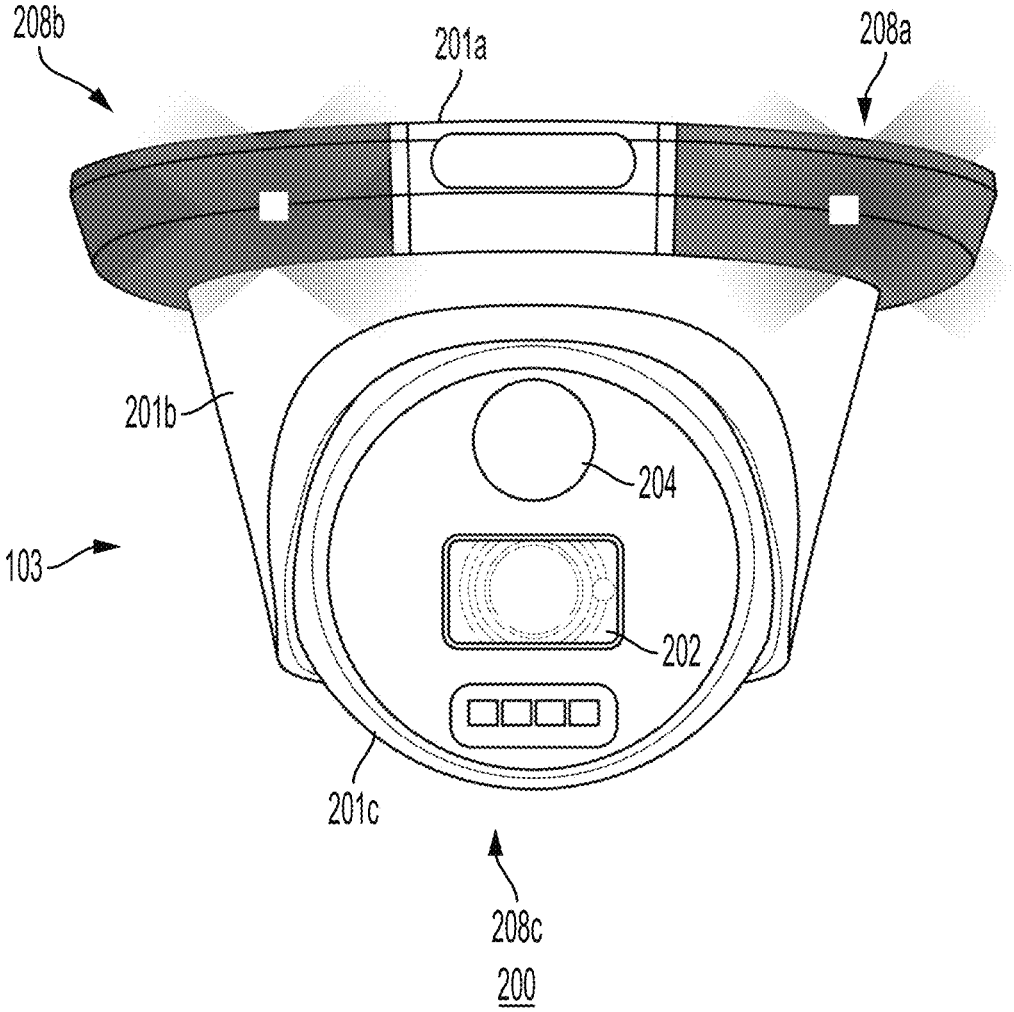
FIG. 5 is a perspective view drawing of a security camera.

FIG. 5 is a perspective view drawing of a security camera 200. Security camera 200 may include the same, similar, or substantially the same components and functionality as security cameras 100, 110, 120, and 130. Security camera 200 may include a mount portion 201*a*, a body portion 201*b*, and a camera housing portion 201*c*, for example. In some embodiments, mount portion 201*a* may be configured to be mounted to a horizontal surface such as a ceiling although mount portion 201*a* may be mounted to other vertical and inclined surfaces such as walls and stairwells, for example. In some embodiments, body portion 201*b* may be configured to rotate 360 degrees to increase the potential range of viewing areas. For example, body portion 201*b* may be adjustable by a turntable or other electronically operated structure such as by a rotary system including a rotary motor, ring gear, actuator, or the like. In some embodiments, body portion 201*b* may be rotated by an end user and retained in position by fixation or biasing elements (not illustrated) and in other embodiments controller 103 may control rotation of body portion 201*b* by sending a control signal to an actuator configured to rotate body portion 201*b*.

Additionally, in some embodiments, housing portion 201*c* may rotate up and down in a direction perpendicular to the rotation direction of body portion 201*b*. For example, housing portion 201*c* may be rotatably mounted to body portion 201*b*. In at least one embodiment, housing portion 201*c* is mounted to housing body portion 201*b* by a pair of rods or pins. In some embodiments, housing portion 201*c* may be configured to rotate at least 180 degrees to increase the potential range of viewing areas. For example, housing portion 201*c* may be adjustable by an electronically operated rotary system including a motor, gearing system, actuator, or the like. In some embodiments, housing portion 201*c* may be rotated by an end user and retained in position by fixation or biasing elements (not illustrated) and in other embodiments controller 103 may control rotation of housing portion 201*c* by sending a control signal to an actuator configured to rotate housing portion 201*c*.

Security camera 200 may include a first lighting feature 208*a*, second lighting feature 208*b*, and third lighting feature 208*c*. First lighting feature 208*a* may be configured to emit a blue light, second lighting feature 208*b* may be configured to emit a red light, and third lighting feature 208*c* may be configured to emit a white light. In the disclosed embodiment, first and second lighting features 208*a*, 208*b* may include at least one LED and may be disposed on a side surface of mount portion 201*a*. However, first and second lighting features 208*a*, 208*b* may also be additionally or alternatively disposed on body portion 201*b* or housing portion 201*c*, for example. In some embodiments, mounting portion 201*a* may include a generally circular perimeter shape and a plurality of alternating first and second lighting features 208*a*, 208*b* may be disposed radially around the circular perimeter shape. In other embodiments, first lighting feature 208*a* may be disposed on about half of the circular perimeter shape and second lighting feature 208*b* may be disposed on the remaining portion of the circular perimeter shape, i.e., the other half. In other embodiments still, first lighting feature 208*a* may include a lens or other optical carrier, fiber optic, reflective medium, prism, or the like disposed on about half of the circular perimeter shape and second lighting feature 208*b* a lens or optical carrier, fiber optic, reflective medium, prism, or the like and may be disposed on the remaining portion of the circular perimeter shape, i.e., the other half. Those with skill in the art will readily appreciate that the forgoing explanation regarding the relative location of first and second lighting features 208*a*, 208*b* is only meant as an example and various combinations of those examples are also considered by this disclosure.

In the disclosed embodiment, third lighting feature 208*c* may be configured to emit a white light, for example as a spotlight or floodlight. Third lighting feature 208*c* may be disposed on an external surface of housing portion 201*c*. At least one advantage of having third lighting feature 208*c* mounted on housing portion 201*c* is that housing portion 201*c* may be rotated left/right and up/down via portions 201*a*, 201*b* as explained above. This results in third lighting feature 208*c* being highly customizable as to its projected direction (a direction of emitted white light beams). In this way, controller 103 may rotate portions 201*a*, 201*b* to actively track objects via third lighting feature 208*c* in similar fashion to a spotlight or Q-beam.

Figure 6A:
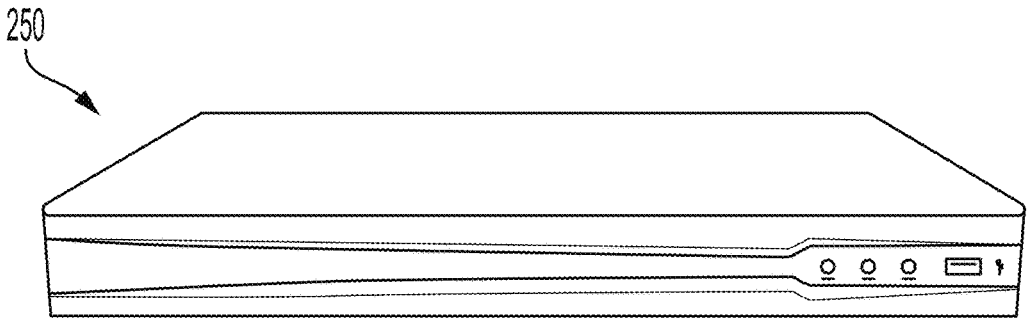
FIG. 6A is a front view drawing of a video recording system.
Figure 6B:
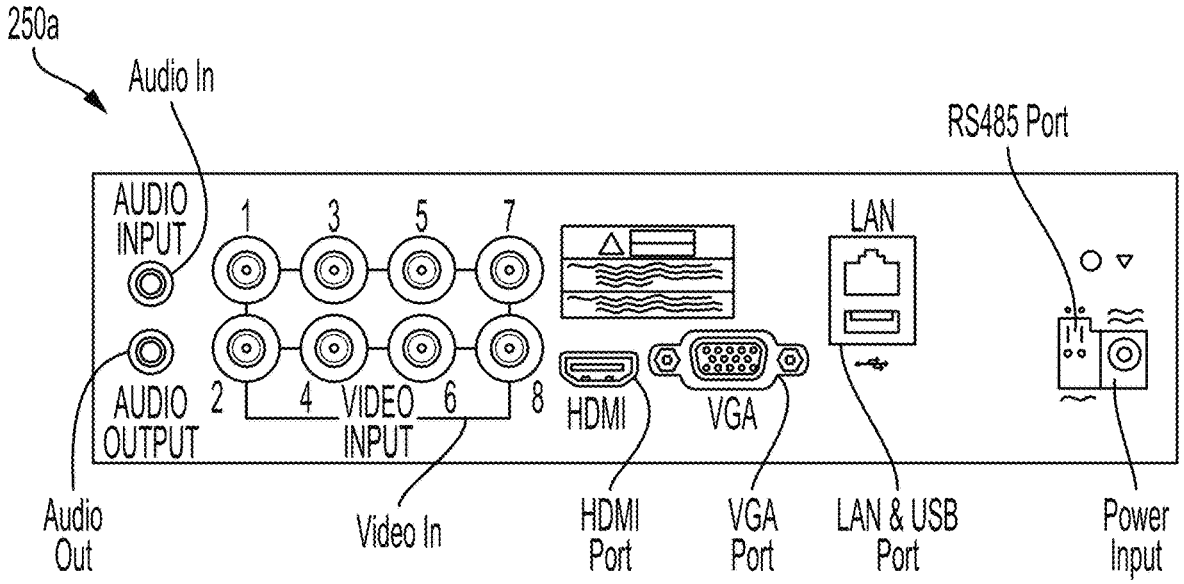
FIG. 6B is a rear view drawing of an example video recording system.
Figure 6C:
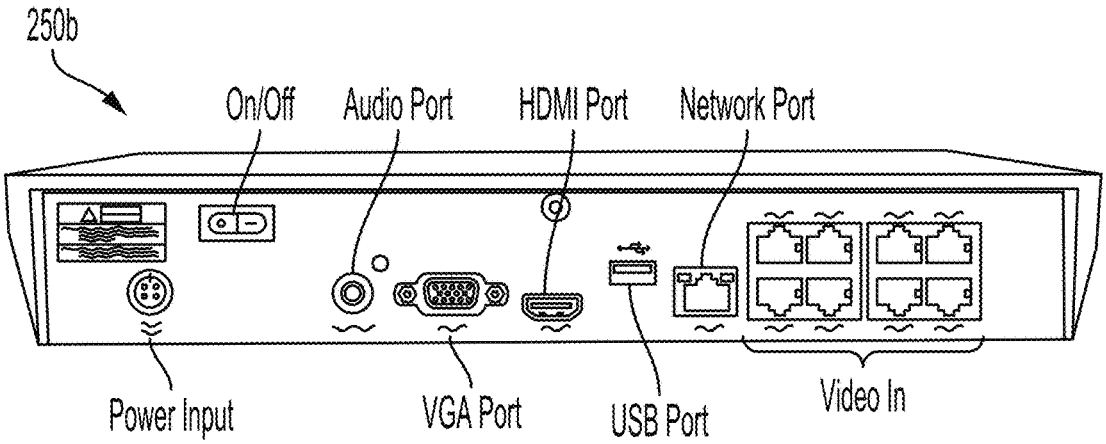
FIG. 6C is a rear view drawing of an example video recording system.

FIG. 6A is a front view drawing of a video recording system 250; FIG. 6B is a rear view drawing of an example digital video recording system (DVR) 250*a*; and FIG. 6C is a rear view drawing of an example network video recording system (NVR) 250*b*. Video recording systems 250*a* and 250*b* may each include a controller having a processor and non-transitory computer readable media storing computer executable instructions. For example, recording systems 250*a* and 250*b* may include an operating system configured for use with Microsoft Windows and Mac OS systems. Each video recording system 250*a*, 250*b* may include at least one video output for connecting to an external display. For example, a video graphics array (VGA) or a high definition multimedia interface (HDMI) port, for example. Accordingly, video recording systems 250*a* and 250*b* may display live feed from cameras 100, 110, 120, 130, and 140 on the external display for an end user to monitor them. Additionally, an end user via an external display may set operating system settings and relevant criteria such as recording information, duration, resolution, etc. of video recording systems 250*a* and 250*b*.

Similarly, each video recording system 250*a* and 250*b* may be configured to record a live camera feed in any resolution, for example 1080p or 4K, for example, on at least one local storage device. An example local storage device may include a hard drive, such as for example a Serial Advanced Technology Attachment (SATA) hard drive. Example hard drives may be solid-state drives with a suitable storage capacity for storing camera feed footage locally. For example a 1 terabyte (TB) hard drive, 2 TB hard drive, 3 TB hard drive, 4 TB hard drive, and etc. In some embodiments, a 1 TB hard drive can store months of video before needing to overwrite older files to free up space. Each of video recording systems 250*a* and 250*b* may be configured to connect to the internet. As used herein, the "internet" may refer to a global computer network providing a variety of information and communication facilities, consisting of interconnected networks using standardized communication protocols. Alternatively or additionally, each of video recording systems 250*a*, 250*b* may be configured to connect to an external secure network ecosystem (as will be explained in more detail below) to send and receive information. For example, video recording systems 250*a* and 250*b* may back up or export video to a personal cloud based storage solution, such as Dropbox, for example, and/or transfer videos locally to an external storage device such as a universal serial bus (USB) memory stick. In some embodiments, an end user may control video recording systems 250*a* and 250*b* to stream a particular feed of a particular camera to an external display by a voice command. For example, an end user may stream video from your camera via a third party smart device and smart platform such as Google Assistant & Chromecast, Google Home Hub, or via Alexa devices with a screen, such as Echo Spot, Echo Show or 4K Fire TV or the like, for example Additionally, in some embodiments the disclosed smart devices and smart platforms may activate the at least deterrent protocol over a security network ecosystem 1001 (see FIG. 13).

In the example embodiment of FIG. 6B, video recording system 250*a* may be configured to receive video input from 8 channels via a BNC connector, however other embodiments may be configured to receive video input from less than or more than 8 channels, for example a range of about 1 channel to about 16 channels. Video recording system 250*a* may send and receive various control signals to a relevant camera, for example camera 100, 110, 120, 130 via the BNC connector. Similarly, video recording system 250*b* may be configured to receive video input from 8 channels via an RJ45 connector however other embodiments may be configured to receive video input from less than or more than 8 channels, for example a range of about 1 channel to about 16 channels. Video recording system 250*b* may send and receive various control signals to a relevant camera, for example camera 100, 110, 120, 130 via the RJ45 connector. However, in some embodiments, disclosed video recording systems 250*a*, 250*b* may send and receive the same or similar information wirelessly via a wireless communication device.

Figure 7:
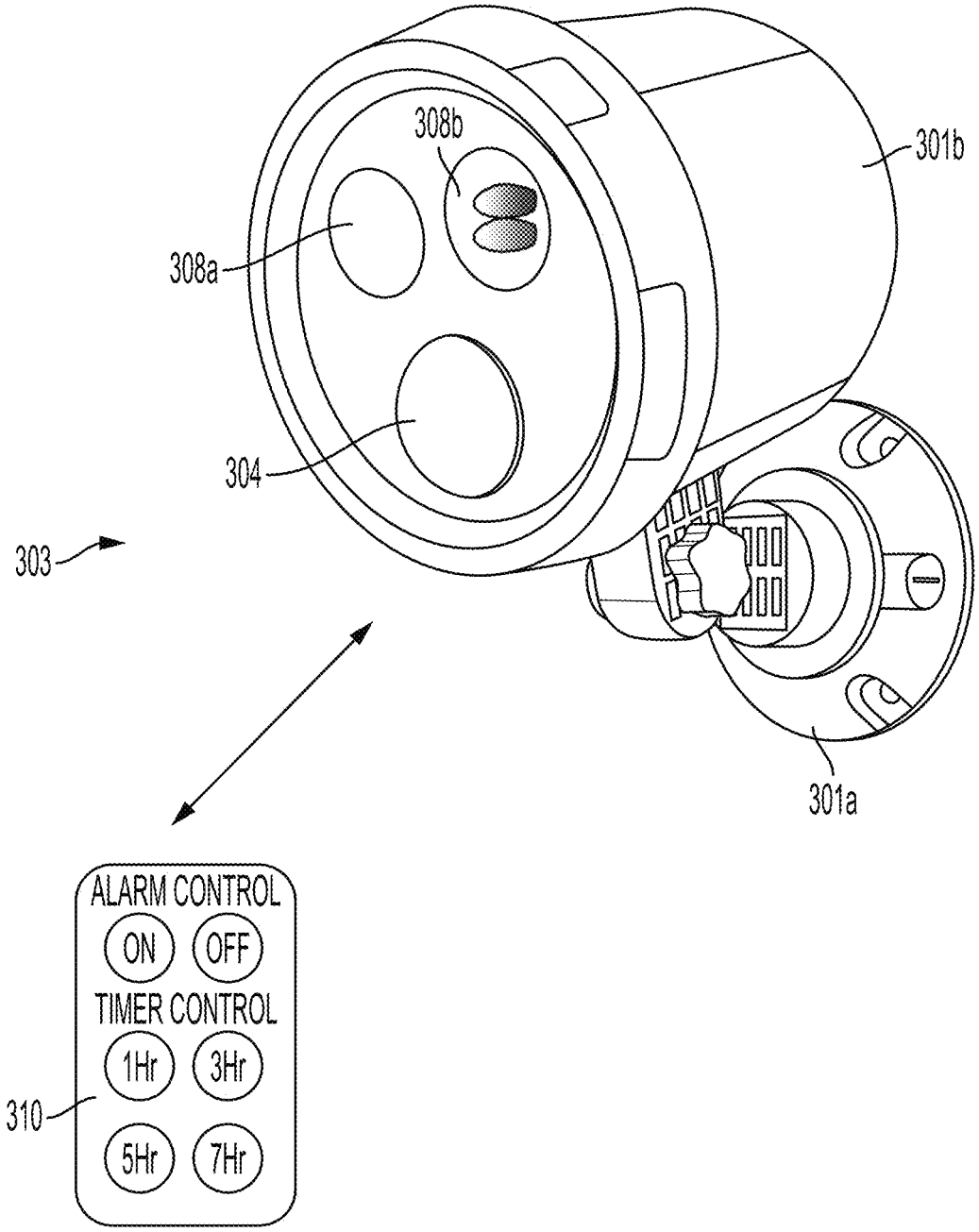
FIG. 7 is a perspective view drawing of a battery operated security motion light.

FIG. 7 is a perspective view drawing of a battery operated security motion light 300. Security motion light 300 may include the same, substantially the same, and/or similar components as disclosed security cameras 100, 110, 120, 130. Security motion light 300 may include a mounting portion 301*a* for affixing the body 301*b* of security motion light 300 to an external structure such as a wall, ceiling, or post, for example Security motion light 300 may be indoor or outdoor rated, e.g., light 300 may be an IP65, IP66, IP67 rated enclosure. Additionally, body 301*b* may pivot with respect to mounting portion 301*a* at a pivoting joint (not labelled). Security motion light 300 may also include, a controller 303, a motion sensor 304, and at least one lighting feature 308*a*, 308*b*.

Motion sensor 304 may be any type of motion sensor such as a passive infrared (PIR) sensor, microwave sensor, and dual tech/hybrid sensors that utilize a combination of PIR sensors and microwave sensors. In at least one embodiment, motion sensor 304 is a PIR sensor including a Fresnel lens to increase the detectable area by channeling off angle infrared radiation from a relatively wider viewing area to the sensor. Motion sensor 304 may include a pyroelectric sensor that is tuned and configured to detect levels of infrared radiation corresponding to that of a human body's heat signature and distinguish the infrared radiation of the human body's heat signature from other types of infrared radiation. For example, the pyroelectric sensor may send an electrical signal to controller 303 notifying controller 303 that heat source movement associated with a heat signature corresponding to that of a human body has been detected.

In the disclosed embodiment of FIG. 7, two distinct lighting regions having distinct colors and being capable of being activated independently are shown. For example, first lighting region 308*a* may include at least one LED cell that transmits white light, for example. In the disclosed embodiment, first lighting region 308*a* may be configured to transmit white light when activated by a control signal of controller 303, for example due to a detected motion, detected dusk or ambient setting, and/or by remote control 310. Second lighting region 308*b* may include at least one LED cell that transmits red and/or blue light, for example. In the disclosed embodiment, second lighting region 308*b* may include at least one LED cell configured to transmit red light when activated by a control signal of controller 303. Second lighting region 308*b* may also include at least one LED cell configured to transmit blue light when activated by a control signal of controller 303. For example, controller 303 may send a control signal to lighting feature 308 activating both the red and blue LED cells of second lighting region 308*b*.

At least one object of the presently disclosed security motion light 300 is the active prevention, deterrence, and/or suppression of unwanted acts and/or crime. In this regard, controller 303 may include at least one processor and non-transitory computer readable media in hardware componentry configured to detect at least one actionable event and initiate at least one deterrent protocol. To effect this outcome, controller 303 may be in communication with motion sensor 304 as previously explained. For example, controller 303 may continuously receive electrical signal output from motion sensor 304. Controller 303 may perform at least some data processing such as the interpretation of data from motion sensor 304. Controller 303 may be configured to detect at least one actionable event based on the combination of data processing and the received electrical signals from motion sensor 304, and activate at least one deterrent protocol if the at least one actionable event is detected.

An example actionable event may include thermal motion detection including thermal data processing of a thermal motion feed from motion sensor 304. For example, thermal motion detection may be required to be detected at least twice within a duration of time ranging from 0.25 seconds to about 3.0 seconds and more particularly about 1 second. In other embodiments, thermal motion detection must be detected more than twice within the above disclosed duration of time. In other embodiments still, the deterrent protocol may only be activated by an end user manually by the remote control 310 and/or the light 300 may be toggled to a setting only allowing the activation of the deterrent protocol via the remote control 310. In other embodiments, a user may enable/disable the deterrent feature and only utilize light 300 as a motion activated light where first lighting region 308*a* may be activated and second lighting region 308*b* may not.

An example deterrent protocol may include various control functions performed by controller 303 as explained above. For example, controller 303 may activate at least one lighting feature 308 and the various sub lighting regions 308*a*, and 308*b*, according to a pre-determined lighting pattern. It shall be understood that activating the at least one lighting feature 308 may selectively include activation of the various sub lighting regions 308*a*, 308*b*, according to a pre-determined lighting pattern individually and in each possible combination. In some embodiments, the pre-determined lighting pattern may include flashing, strobing, or pulsing the red, white, and blue lights of lighting features 308*a*, 308*b*, and 308*c* in a way that resembles a police style warning deterrent, for example Although the disclosed embodiment is not illustrated with a speaker, it shall be appreciated that some embodiments may incorporate a speaker system in the same, substantially the same, or similar manner as explained above with respect to camera 100.

Figure 8A:
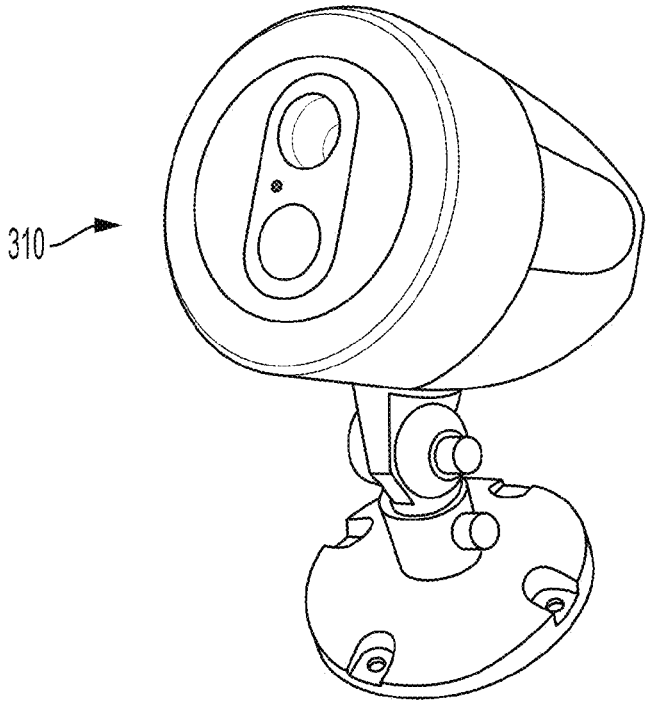
FIG. 8A is a perspective view drawing of a battery operated security motion light.
Figure 8B:
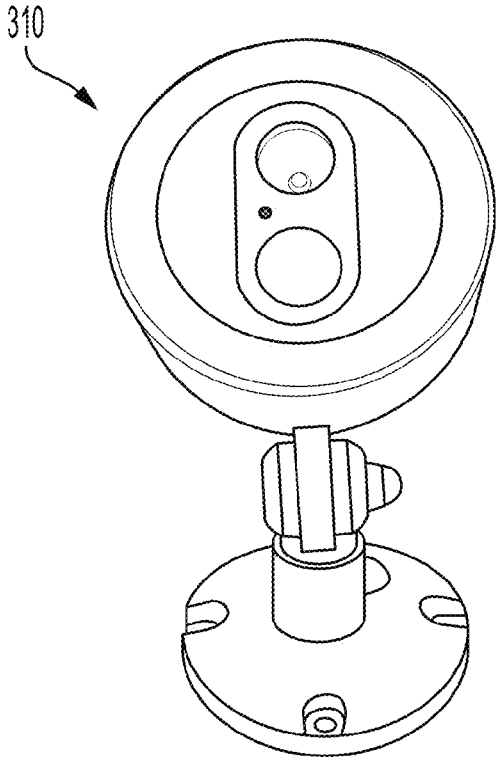
FIG. 8B is a front view of the battery operated security motion light of FIG. 7A.

FIG. 8A is a perspective view drawing of a battery operated security motion light 310 and FIG. 8B is a front view of the battery operated security motion light 310 of FIG. 7A. Light 310 may include the same, substantially the same, and/or similar components as explained above with respect to light 300. In the disclosed embodiment, light 310 may include a single lighting region 308. The single lighting region 308 may include at least one LED chosen from a white light, red light, and blue light. In some embodiments, for example, only a white light is provided. In other embodiments, each of a white light, red light and blue light are provided and they may be activated by a controller according to the above disclosed actionable event criteria to thereby initiate the above disclosed deterrent protocol.

Figure 9A:
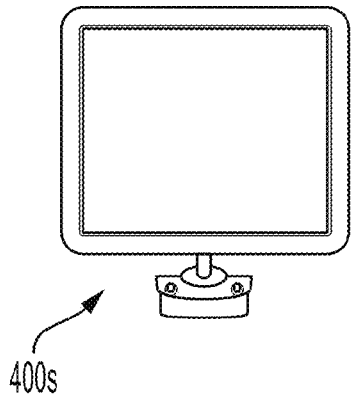
FIG. 9A is a front view of a solar panel.
Figure 9B:
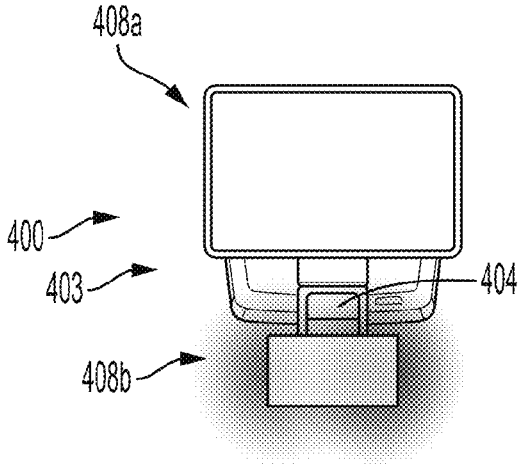
FIG. 9B is a front view of a solar powered security motion light.
Figure 9C:
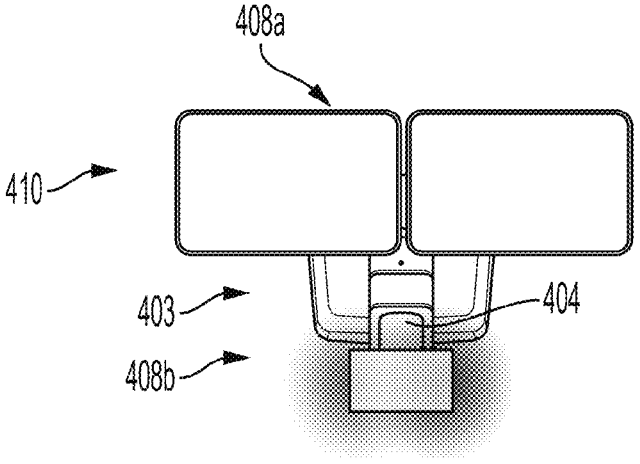
FIG. 9C is a front view of a solar powered security motion light.
Figure 9D:
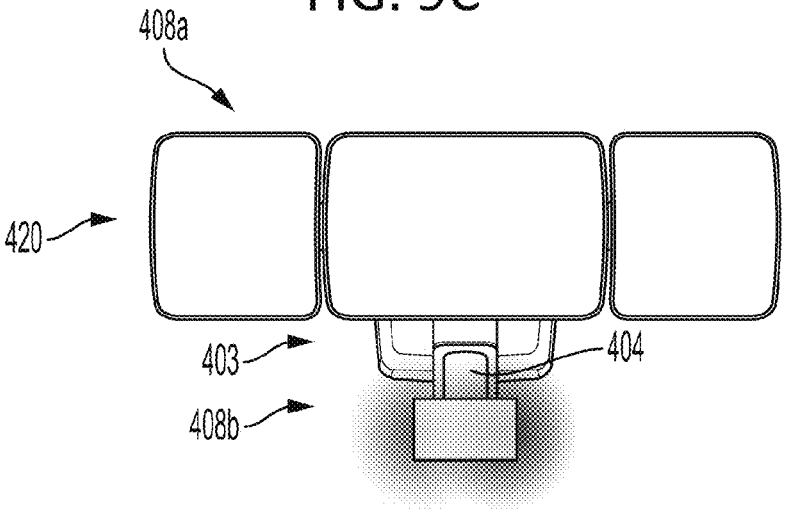
FIG. 9D is a front view of a solar powered security motion light.

FIG. 9A is a front view of a solar panel 400*s*. FIG. 9B is a front view of a solar powered security motion light 400; FIG. 9C is a front view of a solar powered security motion light 410; and FIG. 9D is a front view of a solar powered security motion light 420. It shall be understood that solar panel 400*s* may be configured to provide electrical power to any device, light, or system disclosed in connection with this application. For example, solar panel 400*s* may be configured to provide electrical power from sun-light or other ultraviolet radiation projected onto the solar cells thereof. In some embodiments, solar panel 400*s* may also be equipped with and/or connected to an external battery for storing electrical charge (not illustrated). Solar panel 400*s* may be electrically connected to at least one of lights 400, 410, and 420 for example. Each of lights 400, 410, and 420 may further include a local battery for storage of an electrical charge received from solar panel 400*s*. Although a single solar panel 400*s* is illustrated, it shall be appreciated that multiple solar panels 400*s* may be provided. Additionally, it shall be understood that lights 400, 410, and 420 may include the same, substantially the same, and/or similar components and programmatic functionality as security cameras 100, 120, 120, and 130 and lights 300, and 310 as explained above.

Motion light 400 may include at least one mounting portion for affixing the body of motion light 400 to an external structure such as a wall, ceiling, or post, for example (not labelled). Security motion light 400 may be indoor or outdoor rated, e.g., light 400 may be an IP65, IP66, IP67 rated enclosure. Additionally, the body of light 400 may pivot with respect to the mounting portion at a pivoting joint (not labelled). Security motion light 400 may also include, a controller 403, a motion sensor 404, and at least one first lighting region 408*a* and second lighting region 408*b*.

Motion sensor 404 may be any type of motion sensor such as a passive infrared (PIR) sensor, microwave sensor, and dual tech/hybrid sensors that utilize a combination of PIR sensors and microwave sensors. In at least one embodiment, motion sensor 404 is a PIR sensor including a Fresnel lens to increase the detectable area by channeling off angle infrared radiation from a relatively wider viewing area to the sensor. Motion sensor 404 may include a pyroelectric sensor that is tuned and configured to detect levels of infrared radiation corresponding to that of a human body's heat signature and distinguish the infrared radiation of the human body's heat signature from other types of infrared radiation. For example, the pyroelectric sensor may send an electrical signal to controller 403 notifying controller 403 that heat source movement associated with a heat signature corresponding to that of a human body has been detected.

In the disclosed embodiment, lighting region 408*a* may include at least one LED cell or panel that transmits white light, for example. In the disclosed embodiment, lighting region 408*a* may be configured to transmit white light when activated by a control signal of controller 403, for example due to a detected motion, detected dusk or ambient light setting, and/or by remote control 310 (see FIG. 7). Lighting region 408*b* may include at least one LED cell that transmits red and/or blue light, for example. In the disclosed embodiment, lighting region 408*b* may include at least one LED cell configured to transmit red light and/or at least one LED cell configured to transmit blue light when activated by a control signal of controller 403. For example, controller 403 may send a control signal to lighting region 408*b* activating both the red and blue LED cells of lighting region 408*b*.

At least one object of the presently disclosed security motion light 400 is the active prevention, deterrence, and/or suppression of unwanted acts and/or crime. In this regard, controller 403 may include at least one processor and non-transitory computer readable media in hardware componentry configured to detect at least one actionable event and initiate at least one deterrent protocol. To effect this outcome, controller 403 may be in communication with motion sensor 404 as previously explained. For example, controller 403 may continuously receive electrical signal output from motion sensor 404. Controller 403 may perform at least some data processing such as the interpretation of data from motion sensor 404. Controller 403 may be configured to detect at least one actionable event based on the combination of data processing and the received electrical signals from motion sensor 404, and activate at least one deterrent protocol if the at least one actionable event is detected.

An example actionable event may include thermal motion detection including thermal data processing of a thermal motion feed from motion sensor 404. For example, thermal motion detection may be required to be detected at least twice within a duration of time ranging from 0.25 seconds to about 3.0 seconds and more particularly about 1 second. In other embodiments, thermal motion detection must be detected more than twice within the above disclosed duration of time. In other embodiments still, the deterrent protocol may only be activated by an end user manually by a remote control 310 (see FIG. 7) and/or the light 400 may be toggled to a setting only allowing the activation of the deterrent protocol via the remote control 310 (see FIG. 7), for example. In other embodiments, a user may enable/disable the at least one deterrent feature and only utilize light 400 as a motion activated light where first lighting region 408*a* may be activated and second lighting region 408*b* may not.

An example deterrent protocol may include various control functions performed by controller 403 as explained above. For example, controller 403 may activate at least one lighting feature chosen from lighting regions 408*a*, and 408*b*, according to a pre-determined lighting pattern. It shall be understood that activation of the various sub lighting regions 408*a*, 408*b*, according to a pre-determined lighting pattern may be performed individually and in each possible combination. In some embodiments, the pre-determined lighting pattern may include flashing, strobing, or pulsing the red, white, and blue lights of lighting features 408*a*, 408*b*, in a way that resembles a police style warning deterrent, for example. Although the disclosed embodiment is not illustrated with a speaker, it shall be appreciated that some embodiments may incorporate a speaker system in the same, substantially the same, or similar manner as explained above with respect to camera.

Light 410 may include the same, substantially the same, or similar components as disclosed above with respect to light 400. In addition, light 410 may further include two lighting regions 408*a*. Light 420 may include the same, substantially the same, or similar components as disclosed above with respect to lights 400, 410. In addition, light 420 may further include three lighting regions 408*a*. It shall be understood that the disclosed embodiments are illustrative examples and should not be construed as limiting the size, orientation, or position of disclosed lighting regions 408*a*, 408*b*. Additionally, it shall be understood that when referring to a lighting region or lighting feature as having at least one LED, other embodiments in accordance with the inventive concepts disclosed herein may include a plurality of LED's in that lighting region or lighting feature that are each controlled in the same way.

Figure 10:
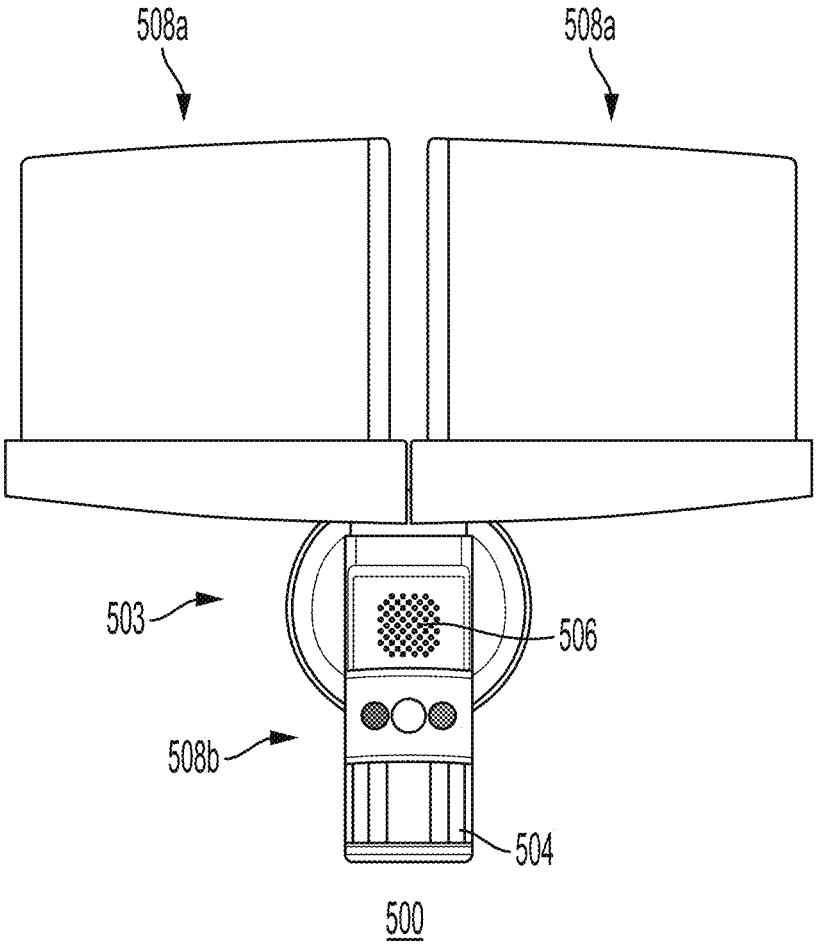
FIG. 10 is a front view of a line voltage powered security motion light.

FIG. 10 is a front view of a line voltage powered security motion light 500. Motion light 500 may include the same, substantially the same, and/or similar components as security cameras 100, 120, 120, and 130 and lights 300, 310, 400, 410, and 420 as disclosed above. Additionally, motion light 500 may be powered by a line voltage power source. For example, a hard-wired electrical source such as a standard electrical outlet or a directly wired electrical source such as a 110-volt alternating current line or another form of electrical current as may be dependent upon the relative geographical location and/or market. For example, some applications may be configured for direct current and/or other voltages.

Motion light 500 may include at least one mounting portion for affixing the body of motion light 500 to an external structure such as a wall, ceiling, or post, for example (not labelled). Security motion light 500 may be indoor or outdoor rated, e.g., light 500 may be an IP65, IP66, IP67 or the like rated enclosure. Additionally, the body of light 500 may pivot with respect to the mounting portion at a pivoting joint (not labelled). Security motion light 500 may also include, a controller 503, at least one motion sensor 504, and at least one first lighting region 508*a* and second lighting region 508*b*. Additionally, motion light 500 may include a speaker 506. Speaker 506 may be a loudspeaker or siren, for example. In some embodiments, speaker 506 may include a microphone for capturing audio and transmitting the captured audio as a corresponding electrical signal to the controller 503. Speaker 506 may be configured to generate any type of sound and in some embodiments multiple speakers may be provided, for example a low frequency speaker, a mid frequency speaker, and a high frequency speaker. In some embodiments, speaker 506 may be configured to generate a police style siren sound upon receipt of a control signal from controller 503, for example upon activation of a deterrent protocol.

Motion sensor 504 may be any type of motion sensor such as a passive infrared (PIR) sensor, microwave sensor, and dual tech/hybrid sensors that utilize a combination of PIR sensors and microwave sensors. In at least one embodiment, motion sensor 504 is a PIR sensor including a Fresnel lens to increase the detectable area by channeling off angle infrared radiation from a relatively wider viewing area to the sensor. Motion sensor 504 may include a pyroelectric sensor that is tuned and configured to detect levels of infrared radiation corresponding to that of a human body's heat signature and distinguish the infrared radiation of the human body's heat signature from other types of infrared radiation. For example, the pyroelectric sensor may send an electrical signal to controller 503 notifying controller 503 that heat source movement associated with a heat signature corresponding to that of a human body has been detected.

In the disclosed embodiment, each lighting region 508*a* may include at least one LED cell that transmits white light, for example. In the disclosed embodiment, lighting region 508*a* may be configured to transmit white light when activated by a control signal of controller 503, for example due to a detected motion, detected dusk or ambient light setting, and/or by remote control 310 (see FIG. 7). Lighting region 508*b* may include at least one LED cell that transmits red and/or blue light, for example. In the disclosed embodiment, lighting region 508*b* may include at least one LED cell configured to transmit red light and/or at least one LED cell configured to transmit blue light when activated by a control signal of controller 503. For example, controller 503 may send a control signal to lighting region 508*b* activating both the red and blue LED cells of lighting region 508*b*.

At least one object of the presently disclosed security motion light 500 is the active prevention, deterrence, and/or suppression of unwanted acts and/or crime. In this regard, controller 503 may include at least one processor and non-transitory computer readable media in hardware componentry configured to detect at least one actionable event and initiate at least one deterrent protocol. To effect this outcome, controller 503 may be in communication with motion sensor 504 as previously explained. For example, controller 503 may continuously receive electrical signal output from motion sensor 504. Controller 503 may perform at least some data processing such as the interpretation of data from motion sensor 504. Controller 503 may be configured to detect at least one actionable event based on the combination of data processing and the received electrical signals from motion sensor 504, and activate at least one deterrent protocol if the at least one actionable event is detected.

An example actionable event may include thermal motion detection including thermal data processing of a thermal motion feed from motion sensor 504. For example, thermal motion detection may be required to be detected at least twice within a duration of time ranging from 0.25 seconds to about 3.0 seconds and more particularly about 1 second. In other embodiments, thermal motion detection must be detected more than twice within the above disclosed duration of time. In other embodiments still, the deterrent protocol may only be activated by an end user manually by a remote control 310 (see FIG. 7) and/or the light 500 may be toggled to a setting only allowing the activation of the deterrent protocol via the remote control 310 (see FIG. 7). In other embodiments, a user may enable/disable the at least one deterrent feature and only utilize light 500 as a motion activated light where first lighting region 508*a* may be activated and second lighting region 508*b* may not.

An example deterrent protocol may include various control functions performed by controller 503 as explained above. For example, controller 503 may activate at least one lighting feature chosen from lighting regions 508*a*, and 508*b*, according to a pre-determined lighting pattern. It shall be understood that activation of the various sub lighting regions 508*a*, 508*b*, according to a pre-determined lighting pattern may be performed individually and in each possible combination. In some embodiments, the pre-determined lighting pattern may include flashing, strobing, or pulsing the red, white, and blue lights of lighting features 508*a*, 508*b*, in a way that resembles a police style warning deterrent, for example. Additionally, light 500 include any suitable wireless transmitter, receiver, etc. for receiving a control signal from, for example, video recorders 250*a* or 250*b* (see FIGS. 6A-6C), and/or security network ecosystem 1001 (see FIG. 13). For example, a radio frequency receiver, a Bluetooth receiver, or a Wi-Fi receiver. A Wi-Fi device may be any device in the family of wireless network protocols, based on the IEEE 802.11 family of standards, which are commonly used for local area networking of devices and Internet access.

Figure 11A:
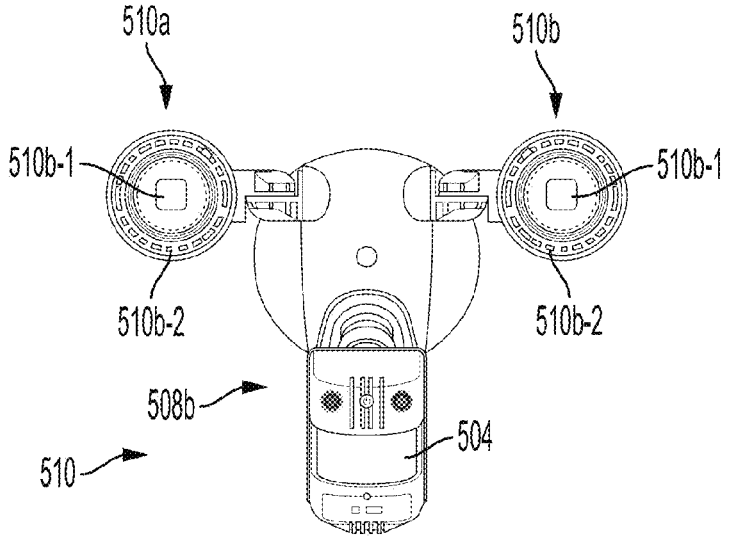
FIG. 11A is a front view of a line voltage powered security motion light.
Figure 11B:
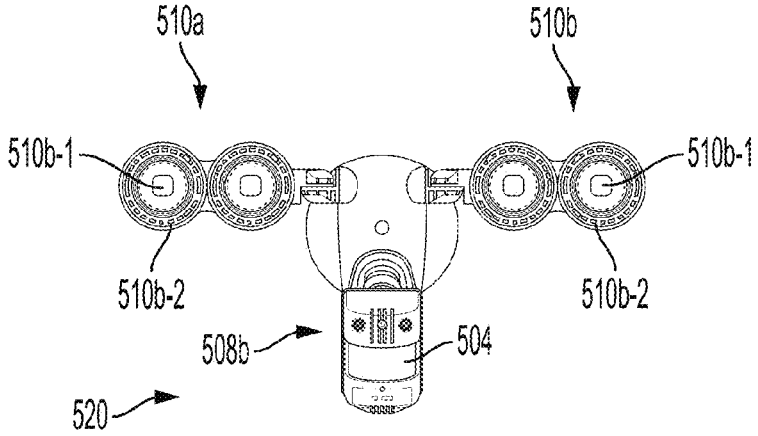
FIG. 11B is a front view of a line voltage powered security motion light.
Figure 11C:
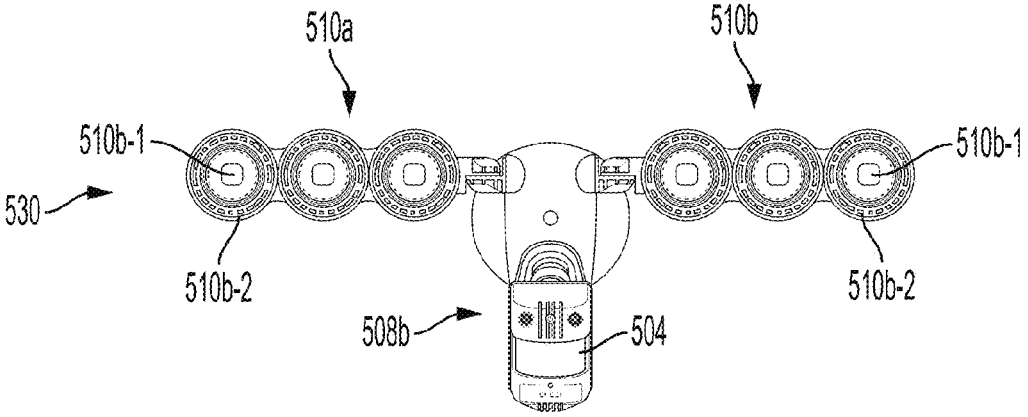
FIG. 11C is a front view of a line voltage powered security motion light.

FIG. 11A is a front view of a line voltage powered security motion light 510; FIG. 11B is a front view of a line voltage powered security motion light 520; and FIG. 11C is a front view of a line voltage powered security motion light 530. Motion lights 510, 520, 530 may have the same, substantially the same, or similar components and programmatic functionality as explained above with respect light 500. For example, lighting region 508*b* may include at least one LED cell that transmits red and/or blue light, for example. In the disclosed embodiment, lighting region 508*b* may include at least one LED cell configured to transmit red light and/or at least one LED cell configured to transmit blue light when activated by a control signal of controller 503. However, lights 510, 520, and 530 may include at least one array of lighting features. For example, light 510 includes a left array of lighting features 510*a* and a right array of lighting features 510*b*. Each array may include a plurality of different types of lighting components. For example, in at least one embodiment a relatively bright LED light 510*a*-1 is disposed in the center of lighting features 510*a* and is configured as a long distance spotlight or alternatively as a flood light, for example. Additionally, lighting features 510*a* may include at least one radially disposed LED light 510*a*-2. In the disclosed embodiment, a plurality of radially disposed LED lights 510*a*-2 are disposed around the perimeter of lighting feature 510*a* as an example. Furthermore, lights 510*a*-2 may be of an alternating color and/or intensity. For example, in some embodiments, red and/or blue lights may be distributed radially around the perimeter of lighting feature 510*a*. It shall be understood that the above description with respect to lighting feature 510*a* is equally applicable to lighting feature 510*b*. Like numbering is provided when convenient for corresponding parts. For example, light 510*b*-1 may correspond to light 510*a*-1, and lights 510*b*-2 may correspond to lights 510*a*-2, for example. However, lighting feature 510*a* and lighting feature 510*b* are not required to be the same and variations are contemplated in accordance with the inventive concepts of this disclosure.

Consistent with the above concepts, the embodiment illustrated in FIG. 11B shows an array of lights 510*a* and an array of lights 510*b*. For example, a total of four lights 510*a*, 510*b* are illustrated, for example. Also consistent with the above concepts, the embodiment illustrated in FIG. 11C shows an array of lights 510*a* and an array of lights 510*b*. For example, a total of eight lights 510*a*, 510*b* are illustrated, for example. It shall be understood that the disclosed embodiments are illustrative examples and should not be construed as limiting the size, orientation, number, or position of disclosed lights 510*a*, 510*b*. Additionally, it shall be understood that when referring to a lighting region or lighting feature as having at least one LED, other embodiments in accordance with the inventive concepts disclosed herein may include a plurality of LED's in that lighting region or lighting feature such as a lighting panel or fiber optic cable that are each controlled in the same way.

Figure 12A:
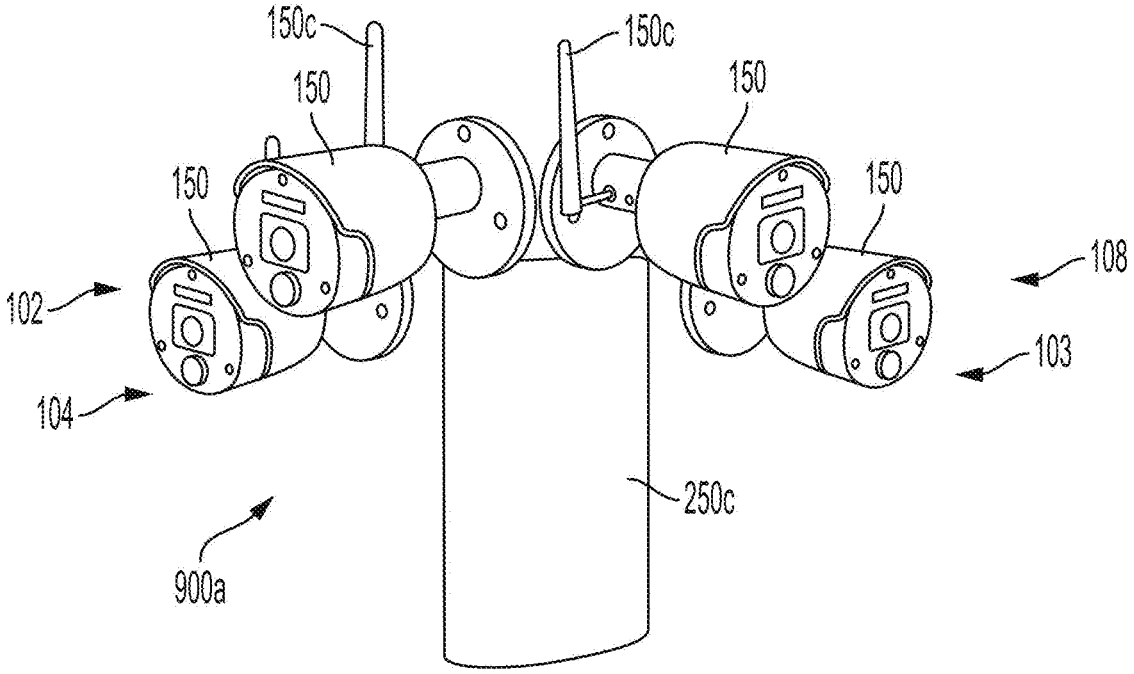
FIG. 12A is a front perspective view of a wireless security system including a wireless security camera and a wireless video recording system.

FIG. 12A illustrates a front perspective view of a wireless security system 900*a*. Wireless security system 900*a* may include a wireless security camera 150 and a wireless video recording system 250*c*, for example. Consistent with the disclosure herein, wireless security camera 150 may send and receive data wirelessly yet also be powered by a hardwired line voltage connection. Wireless security camera 160 may include the same, substantially the same, and or similar features and components as explained above with respect to cameras 100, 110, 120, 130, and 140, for example. Accordingly, duplicative description will be omitted. Wireless security camera 150 may include an antenna 150*c* and a wireless networking interface controller. Antenna 150*c* may be configured to send and receive relevant information back and forth with wireless video recording system 250*c*. For example, antenna 150*c* may send information from camera 102, and/or sensor 104 to wireless video recording system 250*c*, such as a live video feed in 1080p resolution. Likewise, antenna 150*c* may receive information from wireless video recording system 250*c*, such as, for example, a signal to activate at least one deterrent protocol consistent with the disclosure herein. In some embodiments, wireless security camera 160 may be configured to communicate, via antenna 150*c*, with an external security ecosystem (see FIG. 13) directly over the internet via a wireless access point such as a router, for example, and may not include and/or require wireless video recording system 250*c*.

Wireless video recording system 250*c* may be a networked video recorder system including an antenna (not visible) and a wireless networking interface controller, for example. An antenna of wireless video recording system 250*c* may be configured to send and receive relevant information back and forth with wireless security camera 160 and an external security ecosystem over the internet, for example. In some embodiments, wireless security camera 150 and wireless video recording system 250*c* may be configured to communicate over Wi-Fi standards, such as the IEEE 802.11 standard and improvements thereof, for example. In other embodiments, wireless security camera 150 and wireless video recording system 250*c* may be configured to selectively send and receive data over a plurality of different wireless communication standards, such as Wi-Fi, Bluetooth, ZigBee, etc.

Figure 12B:
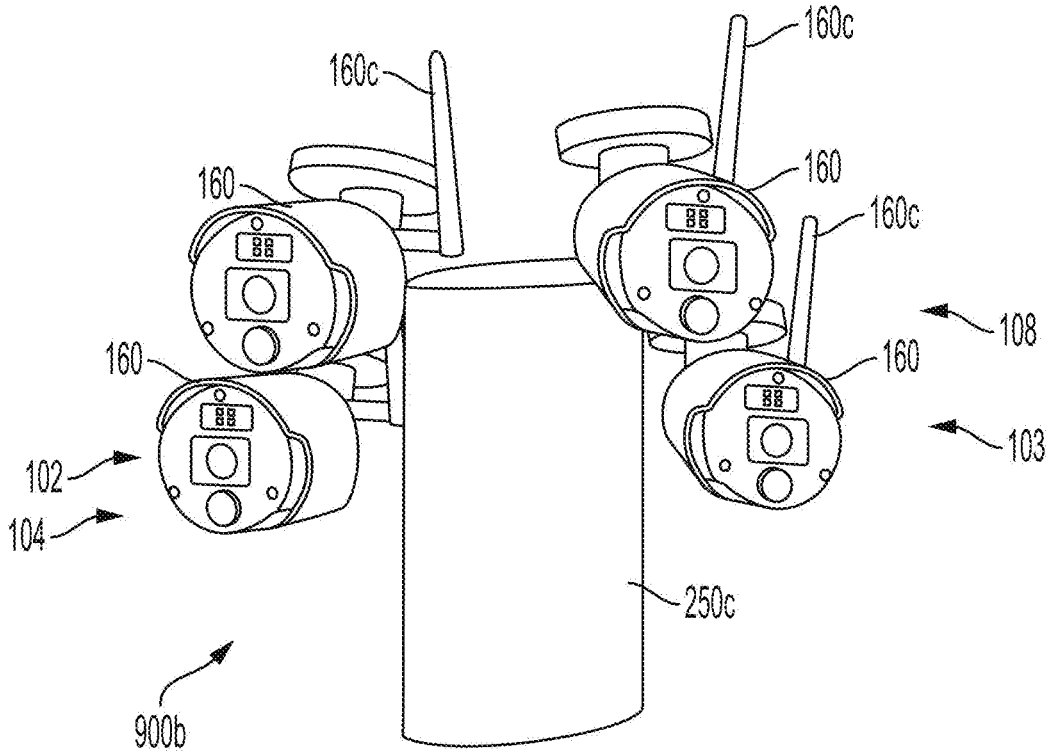
FIG. 12B is a front perspective view of a wireless security system including a wireless security camera and a wireless video recording system.

FIG. 12B is a front perspective view of a wireless security system 900*b* including a wireless security camera 160 and a wireless video recording system 250*c*. Wireless security system 900*b* may include the same, substantially the same, and/or similar features and components as explained above with respect to wireless security system 900*a*. For example, an antenna 160*c* may be configured to function in substantially the same way as antenna 150*c*. However, security camera 160 may include a 4K ultra high definition camera 102 and a different layout of lighting features 108. In some embodiments, wireless security camera 160 and wireless video recording system 250*c* may include both wireless features and components and wired features and components. In at least one embodiment, security camera 160 includes a wireless antenna 160*c* and an Ethernet port. Likewise, wireless video recording system 250*c* may further include a wired connection, such as Ethernet. At least one advantage of having both a wired and wireless communication means may be that an end user has enhanced customizability for particular situations. For example, some contemplated high density regions may have significant interference or obstructions that make wireless installation methods not feasible. Similarly, some regions may allow for a wireless connection of some security cameras 160 and require a wireless connection for other security cameras 160.

Figure 12C:
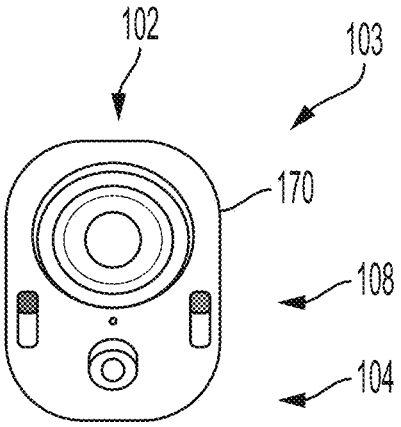
FIG. 12C is a front view of a wireless security camera that is powered locally by a battery.
Figure 12D:
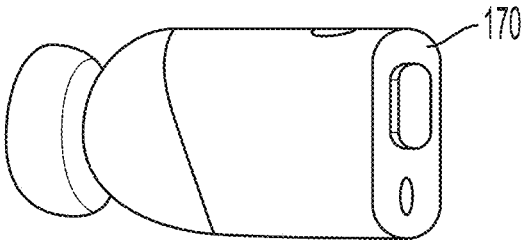
FIG. 12D is a side view of the wireless security camera of FIG. 12C.
Figure 12E:
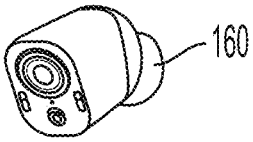
FIG. 12E is a front perspective view of the wireless security camera of FIGS. 12C and 12D.

FIG. 12C is a front view of a wireless security camera 170 that is powered locally by a battery (not visible) or a solar panel (see solar panel 400*s* of FIG. 9A for example). Wireless security camera 170 may include the same, substantially the same, and/or similar components and functionality as explained above with respect to wireless security cameras 150 and 160, for example. However, in some embodiments wireless security camera 170 may include an extra low power consumption camera 102, sensor 104, and/or lighting feature 108. Although not illustrated together, it shall be understood that wireless security camera 170 may be configured to communicate wirelessly with wireless video recording system 250*c* similarly as explained above. FIG. 12D is a side view of the wireless security camera 170 and FIG. 12E is a front perspective view of the wireless security camera of FIGS. 12C and 12D.

Figure 13:
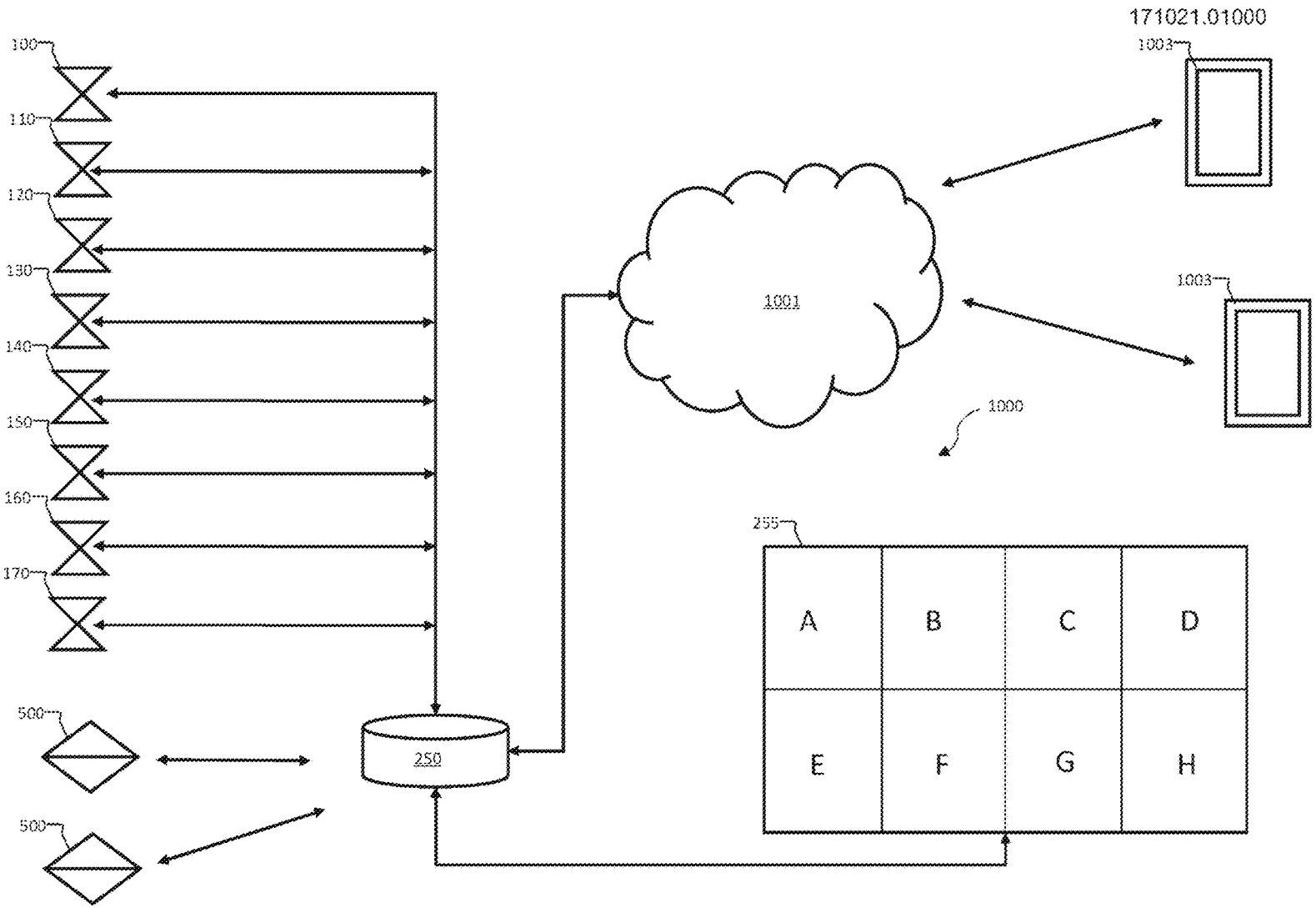
FIG. 13 is a schematic view of a security system and a security network ecosystem.

FIG. 13 is a schematic view of a security system 1000 and a security network ecosystem 1001. Security system 1000 may include, for example, a plurality of security cameras 100, 110, 120, 130, 140, 150, 160, and 170 in wired or wireless communication with a video recorder 250 and a plurality of security motion lights 500. It shall be appreciated that other embodiments may additionally or alternatively utilize any viable amount and combination of the various security cameras of this disclosure and the inventive concepts of security system 1000 are not limited to the precise number and/or type of security cameras shown. It shall also be appreciated that other embodiments may additionally or alternatively utilize a DVR 250*a*, an NVR 250*b*, and/or a wireless video recorder 250*c*, for example, and that the inventive concepts of security system 1000 are not limited merely to a specific video recorder. For example, some security cameras may communicate directly with security ecosystem 1001 over the internet for cloud based storage and data processing by bypassing video recorder 250. It shall also be appreciated that other embodiments may additionally or alternatively utilize any viable amount and combination of disclosed security motion lights and the inventive concepts of security system 1000 are not limited to merely motion lights 500.

In the example embodiment, eight security cameras 100 are shown in two-way communication with video recorder 250 although any number of security cameras 100 is contemplated. Security cameras 100 may be in communication with video recorder 250 via coax, Ethernet, or wirelessly as explained above. Similarly, motion lights 500 may be in communication with video recorder 250 via coax, Ethernet, or wirelessly in the same, substantially the same, or similar manner as security cameras 100. In some embodiments, motion lights 500 are not in communication with video recorder 250 and may instead be able to access the internet directly via a local network or router for example. In other embodiments, motion lights 500 are independent of the video recorder 250 and are not configured to access the internet, i.e., they perform all control functions independently.

Video recorder 250 may further be connected to display 255. Display 255 may be a television, computer monitor, projector, or the like, for example. Video recorder 250 may be configured to partition the viewable area of display 255 into unique viewing areas corresponding to the viewing field and live video feed of each camera 100. For example, viewing area A may correspond to the viewing field of a first camera 100 and viewing area B may correspond to the viewing field of a second camera 100 and so on. Although not illustrated for simplicity, video recorder 250 may further be connected by external control devices such as a keyboard and a mouse, for example.

An end user may update relevant settings of video recorder 250 with the keyboard and mouse such as video storage criteria, external third party data storage platforms, criteria to determine an actionable event as explained above, and criteria related to the deterrence protocol as explained above. For example, an end user may customize the settings for what qualifies as an actionable event from a plurality of pre-set actionable events or an end user may establish custom criteria suitable for the particular individual use case. For example still, an end user may live in a high-density urban environment and may desire to increase the number of times a thermal motion must be detected and/or the duration of time they must be detected within before activating the deterrence protocol.

Similarly, an end user may customize the settings for how to implement the deterrence protocol from a plurality of pre-set deterrence protocols or an end user may establish custom criteria suitable for the particular individual use case. For example still, an end user may live in a high-density urban environment or an environment with noise regulations and may therefore desire to modify the deterrence protocol to only activate a flashing light pattern of lighting feature 108 without utilizing speaker 106. Similarly, an end user may desire to first activate lighting feature 108 as a preliminary warning according to a first set of programming instructions for a first duration of time and then activate speaker 106 according to a second set of programming instructions after the first duration of time has been exceeded.

In the example embodiment, video recorder 250 is connected to the internet, which enables video recorder 250 to communicate with security network ecosystem 1001. As explained previously video recorder 250 may be connected to the internet via a hardwire such as an Ethernet connection or wirelessly via a Wi-Fi standard. Security network ecosystem 10001 may be and/or include a single server, a plurality of networked servers, a plurality of cloud-based servers, and each viable combination thereof. For example, security network ecosystem 1001 may include a computing server, an application server, a communications server, and each may be implemented in hardware and/or software in a cloud based environment as a virtual machine. Ecosystem 1001 may also be in communication with at least one mobile device 1003. Mobile device 1003 may be a portable computer, a tablet, a smart-phone or like.

In at least one embodiment, mobile device is a smart phone configured to communicate with ecosystem 1001 via a cellular tower and/or a local internet connection via Wi-Fi. In at least one embodiment, security network ecosystem 1001 associates a particular user login information with a particular video recorder by using a unique identifier number or a scan able bar code associated with the video recorder 250. In this way, ecosystem 1001 ensures that each connected mobile device 1003 may only communicate with the appropriate approved and paired video recorder device 250. Furthermore, communications with ecosystem 1001 may be encrypted according to any know cryptographic technique, for example. Additionally, multiple mobile devices 1003 may each be granted permission to communicate with security network ecosystem 1001. For example, multiple mobile devices 1003 may be associated with a particular user login information associated with the unique identifier number of video recorder 250.

Mobile device 1003 may include a secure application interface API that is configured to enable two-way communication between ecosystem 1001 and mobile device 1003. At least one advantage to this arrangement is that mobile device 1003 may receive notifications pertaining to the occurrence of actionable events and/or the activation of the deterrence protocol. Additionally, an end user may send a signal to security ecosystem 1001 to activate the deterrence protocol, which in turn relays a corresponding signal to video recorder 250 and thereon to camera 100. The API may have a range of various functionalities. For example, API may allow an end user to see live video feed content from each camera 100. Additionally, API may include the same, substantially the same, and/or similar functionality as the native operating system of video recorder 250. For example, API may enable an end user to modify settings for what qualifies as an actionable event from a plurality of pre-set actionable events or an end user may establish custom criteria suitable for the particular individual use case as previously explained with respect to video recorder 250. Additionally, the API may enable a user to upload relevant facial characteristics of authorized persons. For example, an end user may upload their own facial characteristics via API to security ecosystem 1001 and/or to video recorder 250 by using native photography equipment of mobile device 1003 and/or camera 100. In some embodiments, camera 100 may be configured to rely solely on data processing performed by video recorder 250 when determining an actionable event from data received from camera 100. In this way, disclosed security systems may be configured to ignore actionable events that contain the previously approved and uploaded facial characteristics of authorized persons. At least one advantage to this configuration is the reduction of false positive actionable events inadvertently caused by the end user and other relevant individuals.

In some embodiments, the deterrence protocol may include, flashing alternating light patterns, sounding alarm sounds and/or sirens, notifying the end user by push notification to a mobile device, and notifying the relevant government authorities or even private security authorities, for example. Such authority to be notified can be amended and customized by the end user. For example, an end user may establish computer programmable instructions such that the deterrence protocol also includes a set of instructions to notify local authority and other relevant persons such as neighbors and family members. The notification of local authority and other relevant persons may be performed automatically by ecosystem 1001 or may be performed by a human operator associated with ecosystem 1001 or both.

What is claimed is:

1. A security device, comprising;

at least one camera, the at least one camera being a wired camera or a wireless camera;

at least one thermal motion sensor;

a first lighting feature configured to emit light of a red color and a second lighting feature configured to emit light of a blue color; and a local controller including at least one processor and non-transitory computer readable media, the controller being in communication with the at least one camera and the at least one thermal motion sensor, wherein the controller is configured to:

detect at least one actionable event, and activate at least one deterrent protocol if the at least one actionable event is detected, wherein the at least one actionable event comprises:

video motion detection including video data processing performed on a pixel by pixel basis of a video feed from the at least one camera, the video motion detection being detected at least twice within a duration of time, and thermal motion detection including thermal data processing of a thermal motion feed from the at least one thermal motion sensor, the thermal motion detection being detected at least twice within the duration of time, wherein the at least one deterrent protocol comprises:

activating the first lighting feature and the second lighting feature according to a pre-determined high intensity lighting pattern.

2. The security device of claim 1, further comprising:
a third lighting feature configured to emit white light; and
a speaker configured to generate at least one audible deterrent sound,
wherein the at least one deterrent protocol further comprises:
activating the third lighting feature according to the pre-determined lighting pattern, and activating the speaker.

3. The security device of claim 2, wherein the controller is in communication with an external security ecosystem network, and wherein the controller is further configured to activate the at least one deterrent protocol upon receiving a deterrent signal from the external security ecosystem network.

4. The security device of claim 3, wherein:
the at least one camera is a high definition camera, and
the at least one camera is configured to communicate with the external security ecosystem network over at least one of: a local wired network and/or a Wi-Fi network.

5. The security device of claim 3, wherein:
the at least one camera is a high definition camera with color night vision capability, and
the at least one camera is configured to communicate with the external security ecosystem network over at least one of: a local wired network and/or a Wi-Fi network.

6. The security device of claim 3, wherein the at least one thermal motion sensor is a passive infrared sensor.

7. The security device of claim 3, wherein criteria of the at least actionable event is configurable by an end user.

8. The security device of claim 3, wherein criteria of the at least one deterrent protocol is configurable by an end user.

9. A lighting device, comprising;
at least one thermal motion sensor;
a first lighting feature configured to emit light of a red color and a second lighting feature configured to emit light of a blue color; and
a controller including at least one processor and non-transitory computer readable media, the controller being in communication with the at least one thermal motion sensor, wherein the controller is configured to:
detect at least one actionable event, and
activate at least one deterrent protocol if the at least one actionable event is detected,
wherein the at least one actionable event comprises:
thermal motion detection including thermal data processing of a thermal motion feed from the at least one thermal motion sensor, the thermal motion detection being detected at least twice within a duration of time,
wherein the at least one deterrent protocol comprises:
activating the first lighting feature and the second lighting feature according to a pre-determined high intensity lighting pattern.

10. The lighting device of claim 9, further comprising:
a third lighting feature configured to emit white light,
wherein the at least one deterrent protocol further comprises:
activating the third lighting feature according to the pre-determined lighting pattern.

11. The lighting device of claim 9, further comprising:
a third lighting feature configured to emit white light; and
a speaker configured to generate at least one audible deterrent sound,
wherein the at least one deterrent protocol further comprises:
activating the third lighting feature according to the pre-determined lighting pattern, and activating the speaker.

12. The lighting device of claim 9, wherein the lighting device is a battery powered device.

13. The lighting device of claim 9, wherein the lighting device is a solar powered device.

14. The lighting device of claim 9, wherein the lighting device is a line voltage powered device.

15. A security system, comprising:
a plurality of security devices according to claim 1,
at least one digital video recorder in communication with the at least one security device and an external security ecosystem network, wherein the at least one digital video recorder is configured to:
send a local video signal output including a partitioned viewing area comprising the video feed from each security device of the plurality of security devices,
store video data received from each security device of the plurality of security devices locally,
transmit the video data received from each security device of the plurality of security devices to the external security ecosystem network, and
receive at least one control signal from the external security ecosystem network, wherein the at least one control signal activates the at least one security device locally.

16. The security system of claim 15, further comprising:
a third lighting feature configured to emit white light; and
a speaker configured to generate at least one audible deterrent sound,
wherein the at least one deterrent protocol further comprises:
activating the third lighting feature according to the pre-determined lighting pattern.

17. The security device of claim 15, wherein the at least one thermal motion sensor is a passive infrared sensor.

18. The security device of claim 1, wherein the pre-determined lighting pattern comprises a police style lighting pattern including flashing the red color of the first lighting feature and the blue color of the second lighting feature.

* * * * *